United States Patent [19]

Kawashima et al.

[11] Patent Number: 4,960,686

[45] Date of Patent: Oct. 2, 1990

[54] SILVER HALIDE PHOTOGRAPHIC LIGHT-SENSITIVE MATERIAL CONTAINING OXONOL DYE

[75] Inventors: Yasuhiko Kawashima; Shinri Tanaka, both of Hino; Tamotsu Kojima, Kokubunji; Nobuaki Kagawa, Hachioji, all of Japan

[73] Assignee: Konica Corporation, Tokyo, Japan

[21] Appl. No.: 413,305

[22] Filed: Sep. 27, 1989

[30] Foreign Application Priority Data

Sep. 30, 1988 [JP] Japan ..... 63-244254

[51] Int. Cl.[5] ..... G03C 1/825

[52] U.S. Cl. ..... 430/522; 430/595

[58] Field of Search ..... 430/522, 595

[56] References Cited

U.S. PATENT DOCUMENTS 3,984,246 10/1976 Ohlschlager et al. ..... 430/522

4,130,430 12/1978 Jugiyama et al. ..... 430/522

*Primary Examiner*—Paul R. Michl

*Assistant Examiner*—Janet C. Baxter

*Attorney, Agent, or Firm*—Finnegan, Henderson, Farabow, Garrett and Dunner

[57] ABSTRACT

A silver halide photographic light sensitive material containing a water-soluble oxonol dye is disclosed. The dye is represented by the following Formula I:

(I)

wherein $R^1$ and $R^2$ are each a hydrogen atom, an alkyl group, an aryl group or a alkenyl group; $R^3$, $R^4$, $R^5$ and $R^6$ are each a hydrogen atom, an alkyl group, an aryl group, an alkenyl group or a heterocyclic group provided that at least one of said $R^3$, $R^4$, $R^5$ and $R^6$ is a heterocyclic group and $R^3$ and $R^4$, and $R^5$ and $R^6$ are respectively allowed to bond to form a heterocyclic ring; and the groups represented by said $R^1$ through $R^6$ are allowed to be substituted or unsubstituted provided that at least one of said groups a water-solubilizing group or a group having a water solubilizing group; $L_1$, $L_2$ and $L_3$ are each a substituted or unsubstituted methine group; and n is an integer of zero, 1 or 2.

6 Claims, No Drawings

SILVER HALIDE PHOTOGRAPHIC LIGHT-SENSITIVE MATERIAL CONTAINING OXONOL DYE

FIELD OF THE INVENTION

This invention relates to a silver halide photographic light-sensitive material containing a oxonol dye and, particularly, to a silver halide photographic light-sensitive material containing a hydrophilic colloidal layer which is colored with a dye useful for a light-absorbing dye.

BACKGROUND OF THE INVENTION

It has been well-known that a dye is added into a silver halide photographic light-sensitive material for the purpose of absorbing the rays of light having a specific wavelength so as to work as a filter, prevent halation and irradiation, or control sensitivity. The hydrophilic colloidal layers of the light-sensitive materials are colored with these dyes.

A filter layer has usually been provided onto a light-sensitive emulsion layer or between an emulsion layer and another emulsion layer so as to play a role of making the rays of light incident to an emulsion layer be those of light having a preferable spectral composition. Also, for the purpose of improving the sharpness of photographic images, such a method has been taken in many cases as that an antihalation layer is interposed between an emulsion layer and a support or is provided to the back of the support so that a halation may be prevented by absorbing harmful reflected light which was produced on the interface between the emulsion and the support or on the back of the support; or that harmful reflected or scattered light which was produced by silver halide grains or the like is absorbed by colored emulsion layer so that irradiation may be prevented.

The dyes which may be used with the above-mentioned purposes shall satisfy the following requirements: they shall have the characteristics of absorption spectra which excellently meet the purposes of use; they can completely be decolored in the course of photographic processing steps and/or can easily be eluted from a silver halide photographic light-sensitive material so that no residual color stain can be produced with the dyes after completing a development process: a photographic emulsion cannot be affected by fog, desensitization, or the like; and the stability on standing can be excellent and neither discoloration nor color-fading can be produced in solutions or in the silver halide photographic light-sensitive material.

Heretofore, many efforts have been made and a number of dyes have been proposed with the purpose of discovering the dyes capable of satisfying the above-mentioned requirements. For example, the oxonol dyes described in U.S. Pat. No. 3,247,127, Japanese patent Examined Publication Nos. 39-22069(1964) and 55-10059(1980), and so forth, have been well-known.

However, the present fact is that there has not yet been any dye having excellent characteristics capable of fully satisfying the above-mentioned requirements and of being applied to photographic light-sensitive materials.

In particular, a type of oxonol dyes having a carbamoyl group at the 3rd position have been described in British Patent No. 1,338,799, and Japanese Patent Publication Open to Public Inspection (hereinafter referred to as Japanese Patent O.P.I. Publication) Nos. 51-77327(1976), 58-143342(1983), 59-111641(1984), and 63-139944(1988), and so forth. Among them, the dyes described in British Patent No. 1,338,799 and Japanese Patent O.P.I. Publication No. 51-77327(1976) have not any solubilizing group in the molecular structures thereof and, therefore, insoluble to water or hardly soluble thereto.

In addition, the photographic processing has usually been carried out within a short time and under the low alkaline conditions. It is therefore, difficult to make these dyes elute completely from photographic material. It is also considered that the dyes having once been decolored may recur, or that the decolored dyes may exert a bad influence photographically even if they do not recur. Therefore, particularly in the case of using such a dye in a multi-layered photographic material for the above-mentioned purpose, it is desired to make the dye water-soluble by introducing a water-solubilizing group into the dye. Resultingly, such a water-soluble dye may readily be eluted from the light-sensitive material in the course of the developing process. Therefore, the dye does not remain as it is.

In addition, if the dye is water-soluble, there is such an advantage that the dye may be added in the form of a aqueous solution into a photographic material. On the other hand, if the dye is hardly soluble to water, an organic solvent or the like should be additionally used in combination. It is undesirable to do so from the viewpoint of harmfulness thereof.

The dyes described in Japanese Patent O.P.I. Publication Nos. 58-143342(1983), 59-111641(1984) and 63-139944(1988), each of which is an oxonol dye having a water-solubilizing group and a carbamoyl group at the 3rd position thereof, are not satisfactory in their characteristics, particularly in decoloring property. Therefore, these dyes have been required to be further improved from the above-mentioned viewpoint.

SUMMARY OF THE INVENTION

It is an object of the invention to provide a silver halide photographic light-sensitive material containing a water-soluble dye which is excellent in spectral absorption characteristics and photographically inert in the light-sensitive material and is readily decolored and/or eluted in the course of a photographic development process so as to produce very few stains after completing the photographic development process.

The above-mentioned object of the invention can be achieved with a silver halide photographic light-sensitive material containing a water-soluble oxonol dye represented by the following Formula I:

Formula I

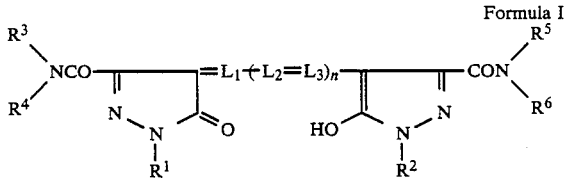

wherein $R^1$ and $R^2$ are each a hydrogen atom, an alkyl group, an aryl group or a alkenyl group: $R^3$, $R^4$, $R^5$ and $R^6$ are each a hydrogen atom, an alkyl group, an aryl group, an alkenyl group or a heterocyclic group provided that at least one of the $R^3$, $R^4$, $R^5$ and $R^6$ is a heterocyclic group and $R^3$ and $R^4$, and $R^5$ and $R^6$ are respectively allowed to bond to form a heterocyclic ring: and the groups represented by the $R^1$ through $R^6$ are allowed to substituted or unsubstituted provided that at least one of the groups is a water solubilizing group or a group having a water solubilizing group; $L_1$, $L_2$ and $L_3$ are each a substituted or unsubstituted methine group; and n is an integer of zero, 1 or 2.

DETAILED DESCRIPTION OF THE INVENTION

The water-soluble oxonol dyes applicable to the invention are represented by Formula I. The groups represented by $R^1$ through $R^4$ each denoted in the formula may further have a substituent or may not have any substituent. Such groups represented by $R^1$ through $R^6$ will be exemplified below.

The alkyl groups represented by $R^1$ through $R^4$ include, for example, a methyl group, an ethyl group, a propyl group, an isopropyl group, an n-butyl group, a tertiary butyl group, acyclopentyl group, and a cyclohexyl group. The alkyl groups include those each having a substituent. Such substituents include, for example, a hydroxy group, a cyano group, a sulfo group, a carboxyl group, halogen atoms such as a fluorine atom, a chlorine atom and a bromine atom, alkoxy groups such as a methoxy group and an ethoxy group, aryloxy groups such as a phenoxy group, a 4-sulfophenoxy group and a 2,4-disulfophenoxy group, aryl groups such as a phenyl group, a 4-sulfophenyl group and a 2,5-disulfophenyl group, alkoxycarbonyl groups such as a methoxycarbonyl group and an ethoxycarbonyl group, and aryloxycarbonyl groups such as a phenoxycarbonyl group.

The aryl groups represented by $R^1$ through $R^4$ include those each having a substituent. The aryl groups include, for example, a phenyl group, a 2-methoxyphenyl group, a 4-nitrophenyl group, a 3-chlorophenyl group, a 4-aminophenyl group, a 4-hydroxyphenyl group, a 4-methanesulfonylphenyl group, a 4-sulfophenyl group, a 3-sulfophenyl group, a 2-sulfophenyl group, a 2-methyl-4-sulfophenyl group, a 2-chloro-4-sulfophenyl group, a 4-chloro-3-sulfophenyl group, a 2-chloro-5-sulfophenyl group, a 2-methoxy-5-sulfophenyl group, a 2-hydroxy-4-sulfophenyl group, a 2,5-dichloro-4-sulfophenyl group, a 2,6-diethyl-4-sulfophenyl group, a 2,5-disulfophenyl group, a 3,5-disulfophenyl group, a 2,4-disulfophenyl group, a 4-phenoxy-3-sulfophenyl group, a 2-chloro-6-methyl-4-sulfophenyl group, a 3-carboxy-2-hydroxy-5-sulfophenyl group, a 4-carboxyphenyl group, a 2,4-dicarboxyphenyl group, a 3,5-dicarboxyphenyl group, a 2,4-dicarboxyphenyl group, a 3,6-disulfo-α-naphthyl group, an 8-hydroxy-3,6-disulfo-α-naphthyl group, a 5-hydroxy-7-sulfo-β-naphthyl group, and a 6,8-disulfo-β-naphthyl group.

The alkenyl groups represented by $R^1$ through $R^6$ include, for example, a vinyl group and an allyl group, and such alkenyl groups include those each having a substituent.

The heterocyclic groups represented by $R^3$ through $R^6$ include those each having a substituent. Such heterocyclic groups include, for example, pyridyl groups such as a 2-pyridyl group, a 3-pyridyl group, a 4-pyridyl group, a 5-sulfo-2-pyridyl group, a 5-carboxy-2-pyridyl group, a 3,5-dichloro-2-pyridyl group, a 4,6-dimethyl-2-pyridyl group, a 6-hydroxy-2-pyridyl group, a 2,3,5,6-tetrafluoro-4-pyridyl group and a 3-nitro-2-pyridyl group, oxazolyl groups such as a 5-sulfo-2-benzoxazolyl group, a 2-benzoxazolyl group and a 2-oxazolyl group, thiazolyl groups such as a 5-sulfo-2-benzthiazolyl group and a 2-thiazolyl group, imidazolyl groups such as a 1-methyl-2-imidazolyl group, a 1-methyl-5-sulfo-2-benzimidazolyl group, furyl groups such as a 3-furyl group, pyrrolyl groups such as a 3-pyrrolyl group, thienyl groups such as a 2-thienyl group, pyrazinyl groups such as a 2-pyrazinyl group, pyrimidinyl groups such as a 2-pyrimidinyl group and a 4-chloro-2-pyrimidinyl group, pyridazinyl groups such as a 2-pyridazinyl group, purinyl groups such as an 8-purinyl group, isoxazolinyl groups such as a 3-isoxazolinyl group, selenazolyl groups such as a 5-sulfo-2-selenazolyl group, sulforanyl groups such as a 3-sulforanyl group, piperidinyl groups such as a 1-methyl-3-piperidinyl group, pyrazolyl groups such as a 3-pyrazolyl group, and tetrazolyl groups such as a 1-methyl-5-tetrazolyl group.

In $R^3$ through $R^6$, $R^3$ and $R^4$, and $R^5$ and $R^6$ are capable of bonding to complet a ring. Such rings include, for example, a piperazyl group, a piperidyl group, a morpholino group and those each having a substituent.

At least one of the groups represented by $R^1$ through $R^6$ is required to have a substituent solubilizing group such as a sulfo group, a sulfinyl group, a carboxyl group, a phosphono group, a phosphoryl group, a hydroxyl group, a sulfuric acid ester group, or a group containing one of the above-given groups so as to serve as a group capable of giving water-solubility to the dye.

The oxonol dyes of the invention will be more preferable when $R^3$ and $R^4$ represent each a hydrogen atom or an alkyl group and $R^4$ and $R^6$ represent heterocyclic groups which may be the same with or the different from each other, and will be further preferable when $R^3$ and $R^5$ represent each a hydrogen atom, and $R^4$ and $R^6$ represent heterocyclic groups which may be the same with or the different from each other.

It will be particularly preferable when $R^3$ and $R^5$ each represent a hydrogen atom and $R^4$ and $R^6$ represent each the same heterocyclic group. In this case, it is necessary that the nitrogen atom of amido at the third position of the pyrazolone ring should bond to a carbon atom of a heterocyclic ring represented by $R^4$ or $R^6$.

Some typical examples of the dyes represented by Formula I, which may be applied to the invention, will be given below. It is, however, to be understood that the invention shall not be limited to the dyes given below.

Exemplified Compound

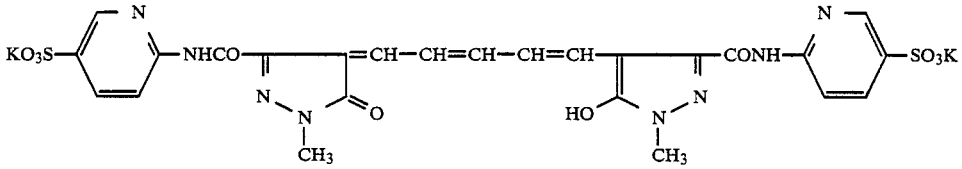

1.

-continued
2.
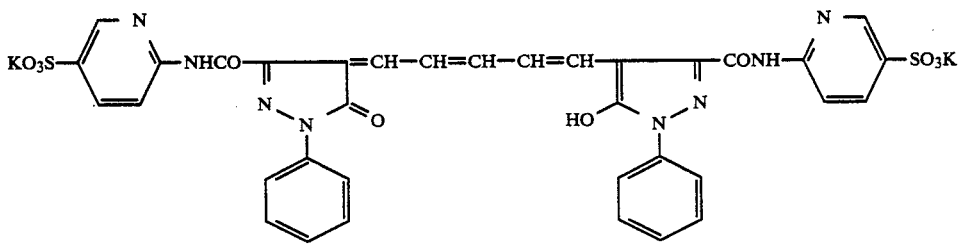
3.
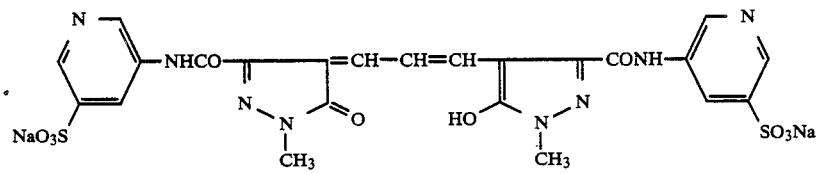
4.
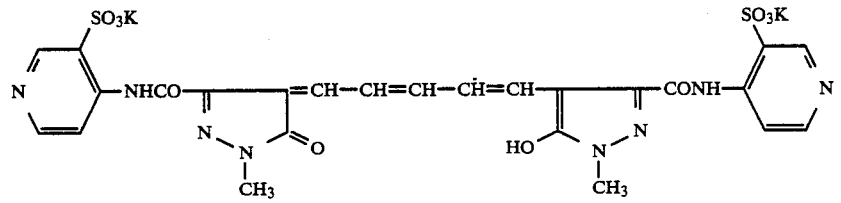
5.
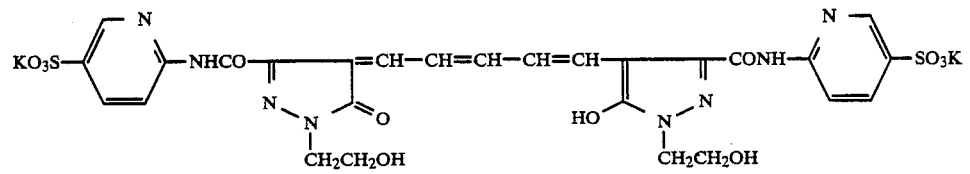
6.
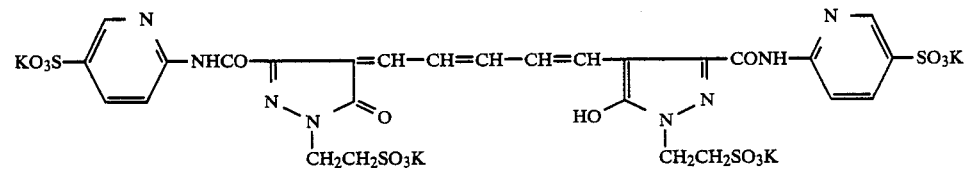
7.
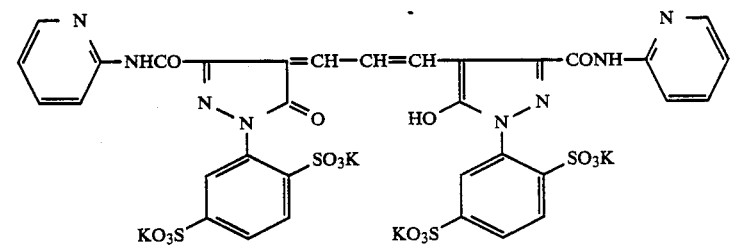
8.
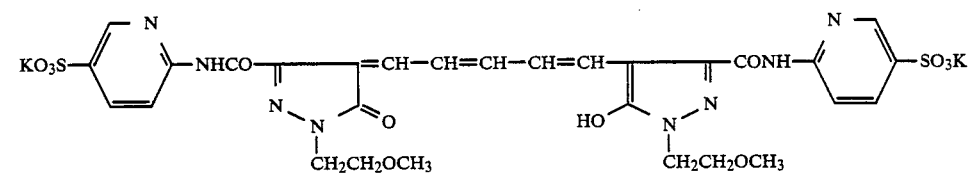
9.
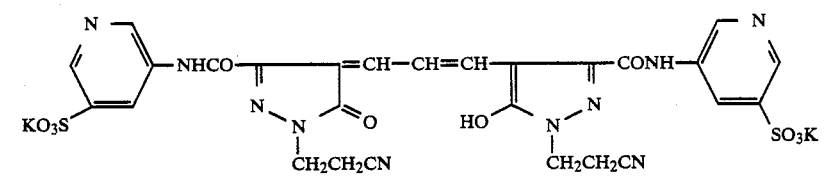

-continued
10.
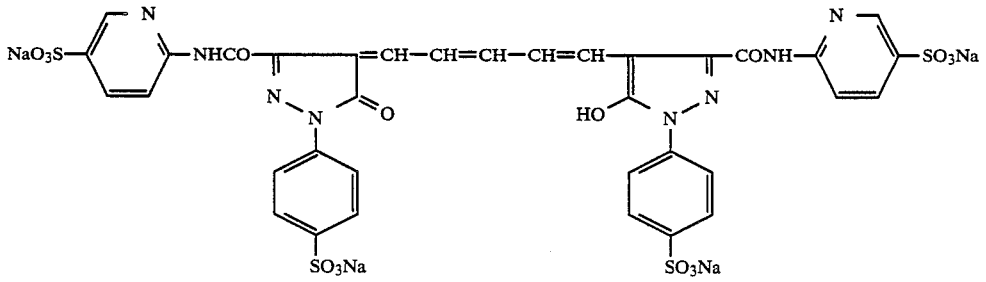
11.
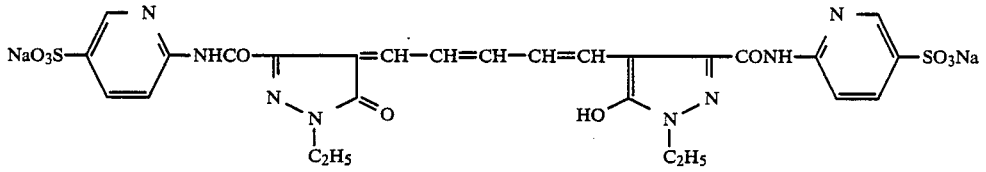
12.
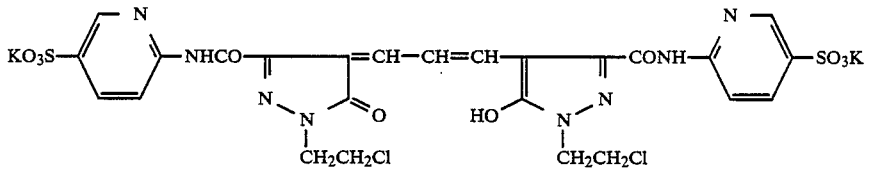
13.
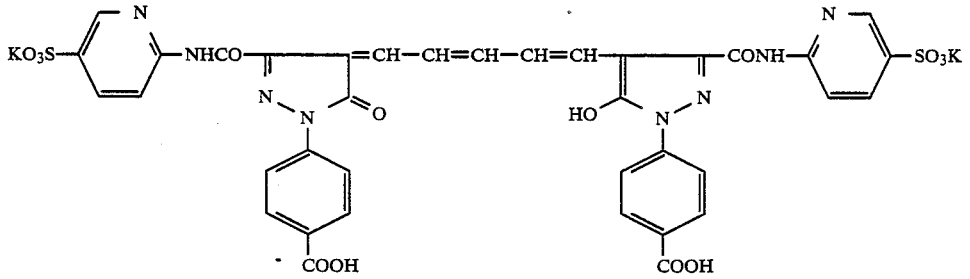
14.
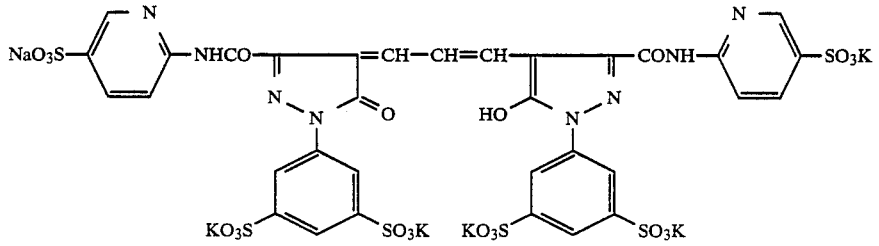
15.
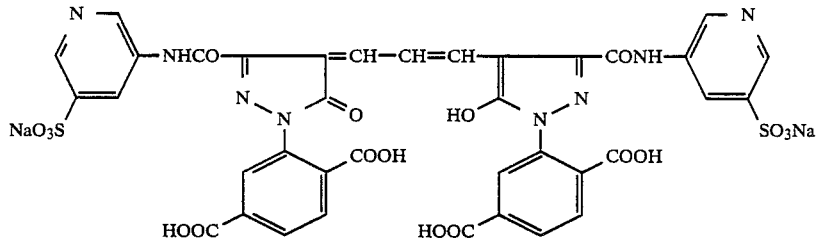

-continued
16.
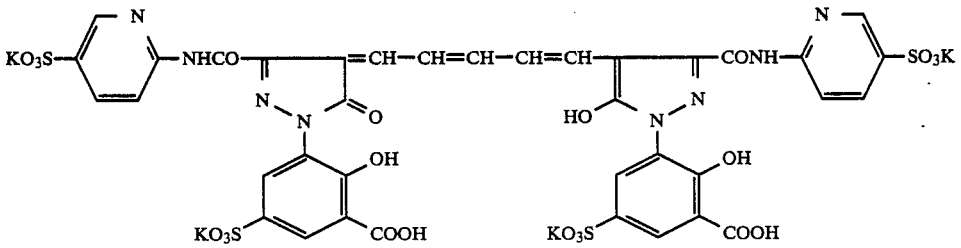
17.
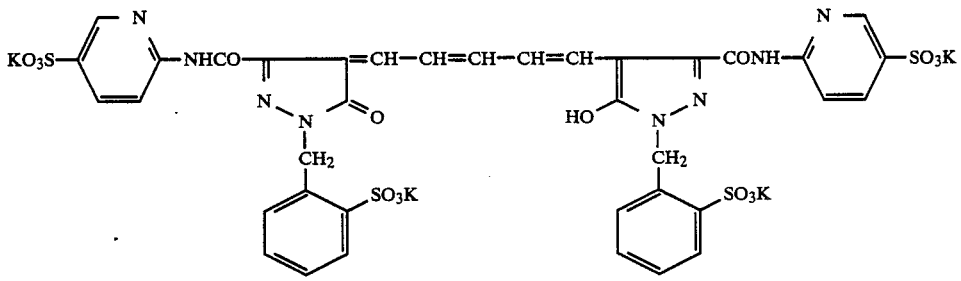
18.
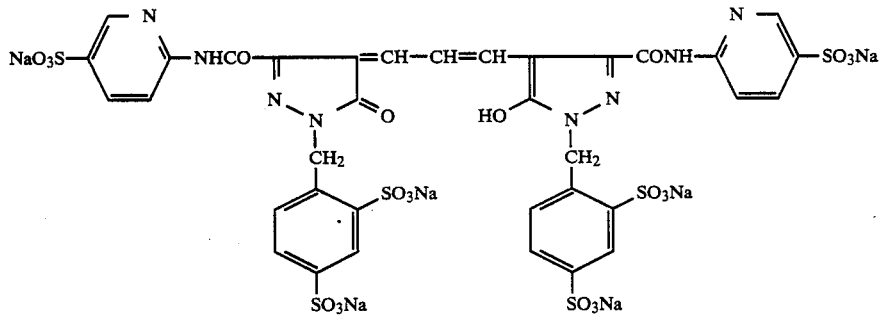
19.
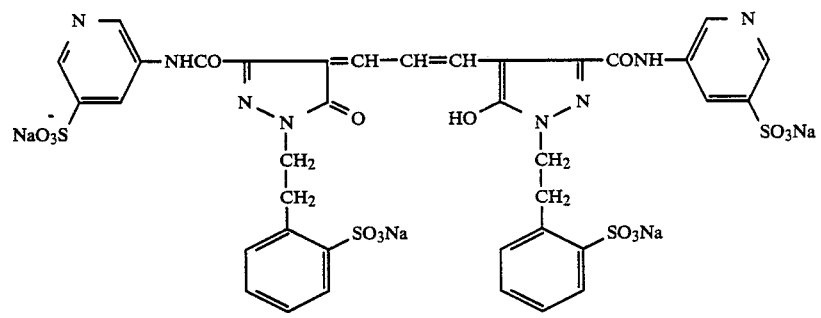
20.
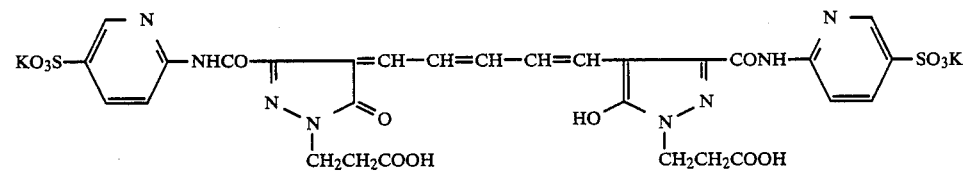
21.
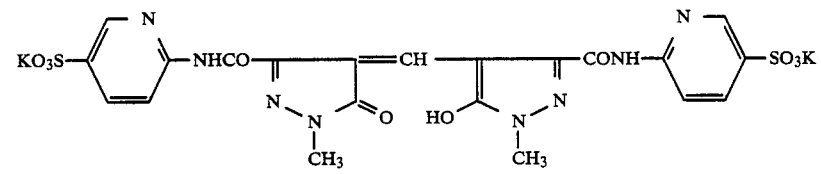

-continued
22.
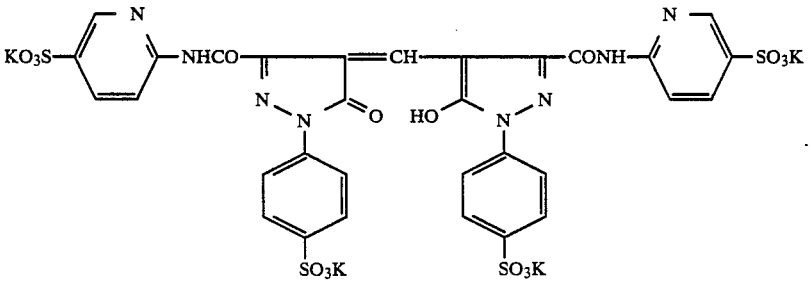
23.
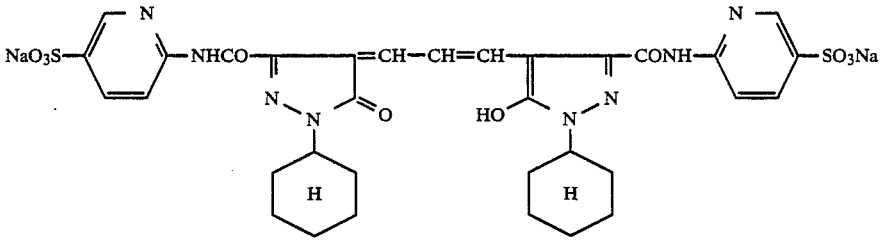
24.
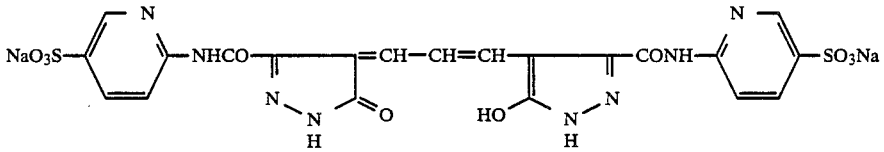
25.
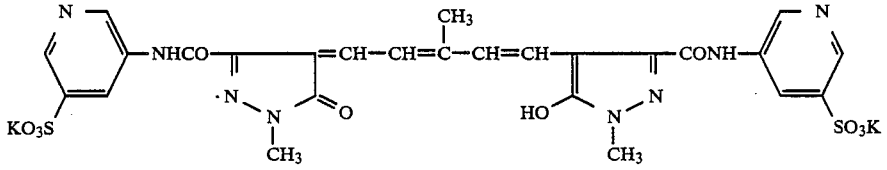
26.
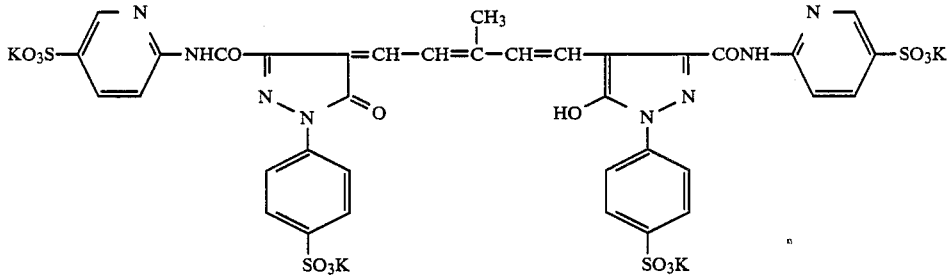
27.
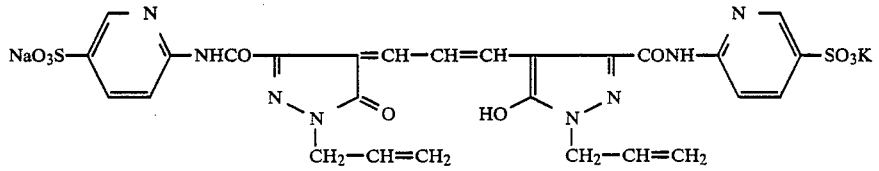
28.
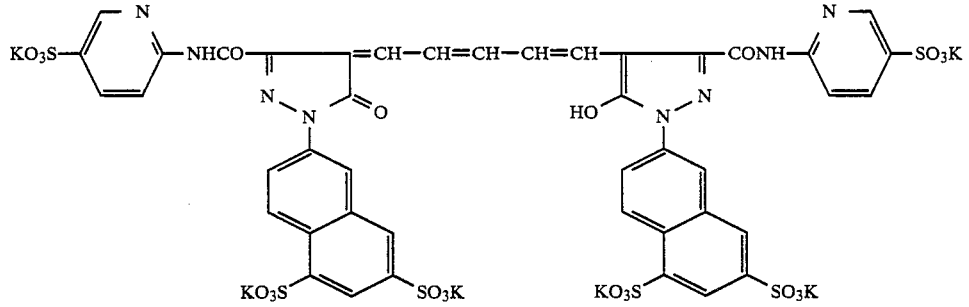

-continued
29.
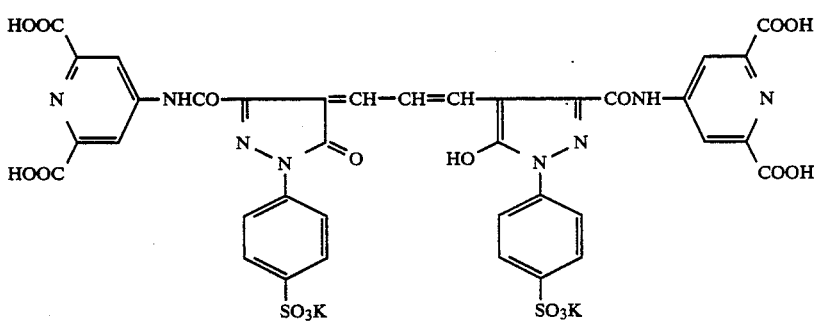
30.
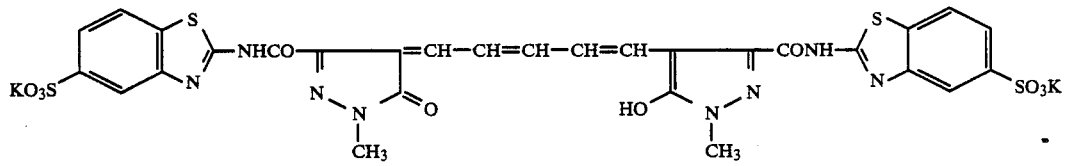
31.
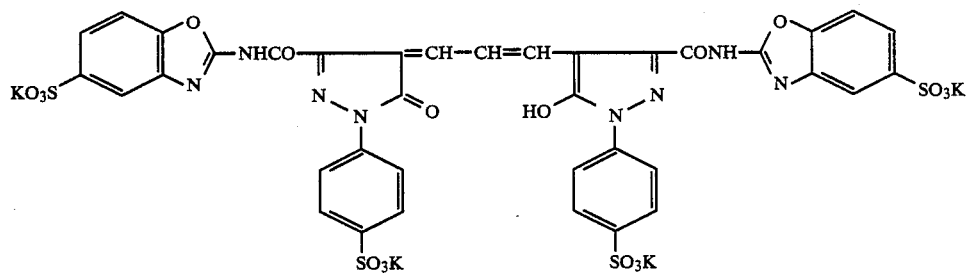
32.
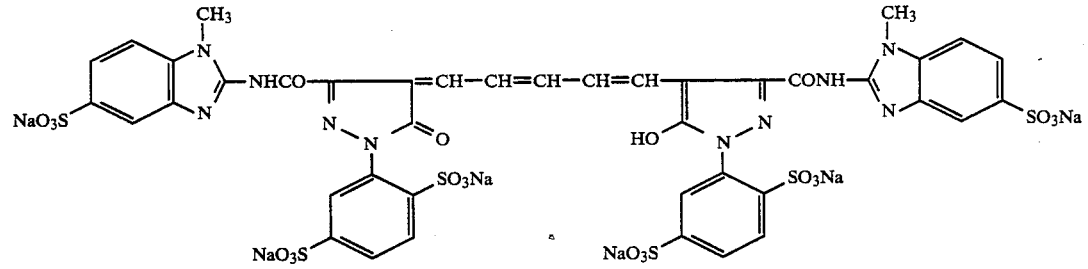
33.
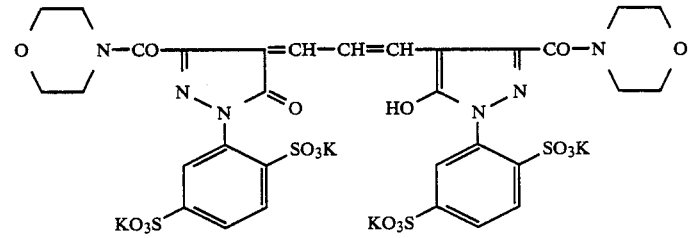
34.
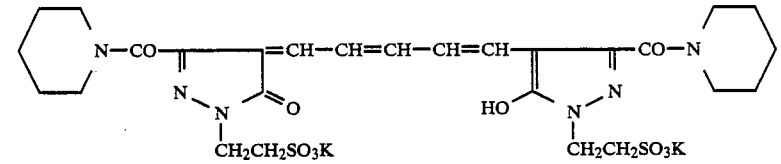

-continued
35.
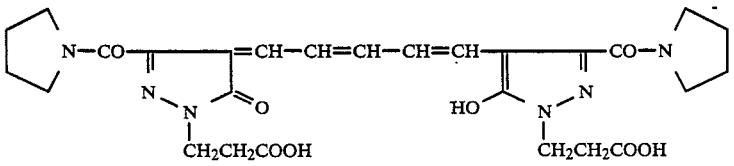
36.
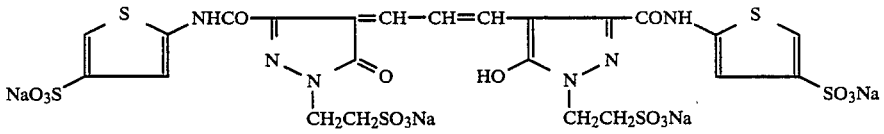
37.
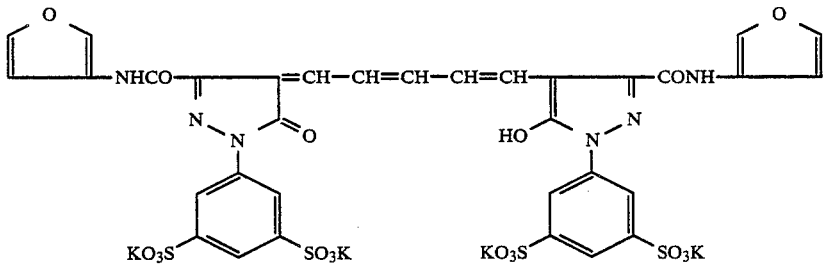
38.
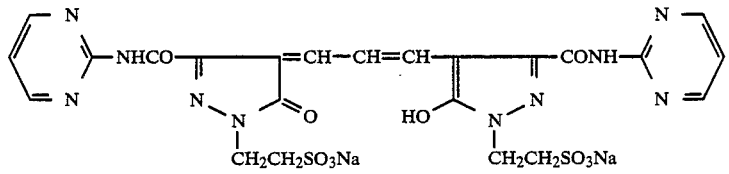
39.
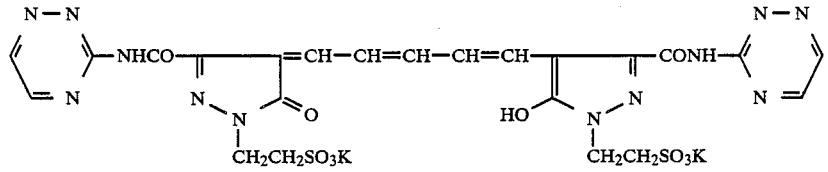
40.
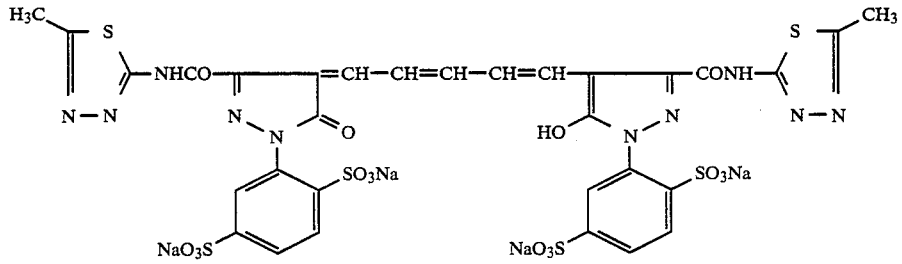
41.
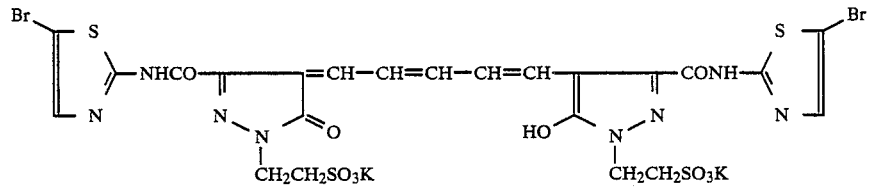

-continued
42.
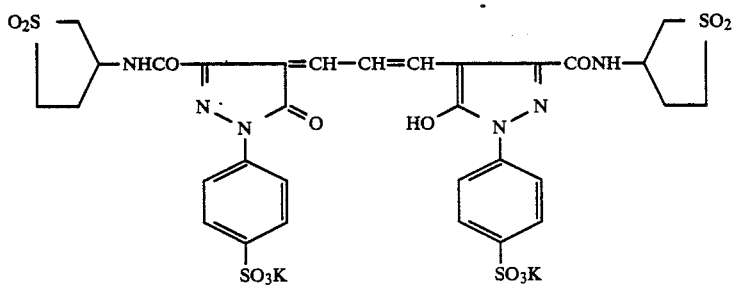
43.
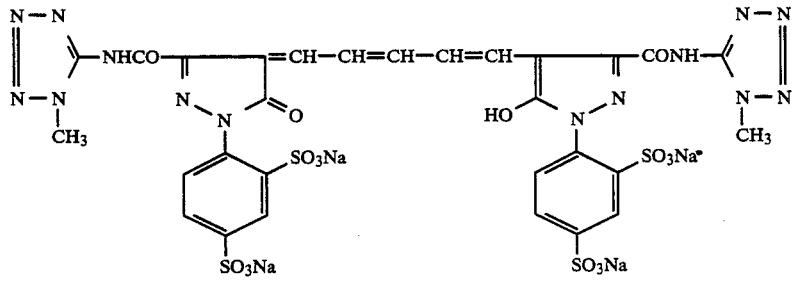
44.
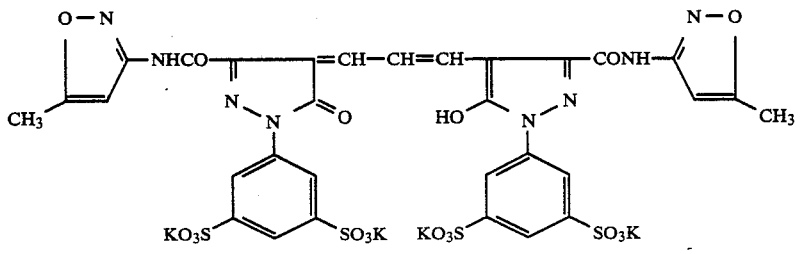
45.
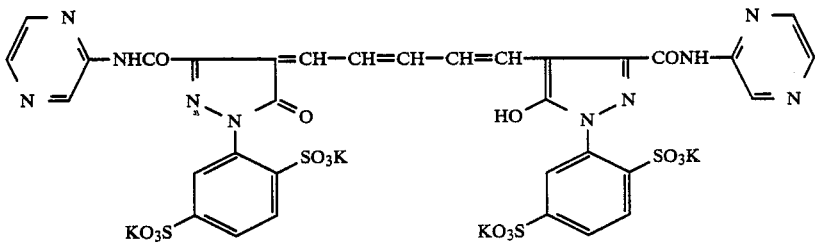
46.
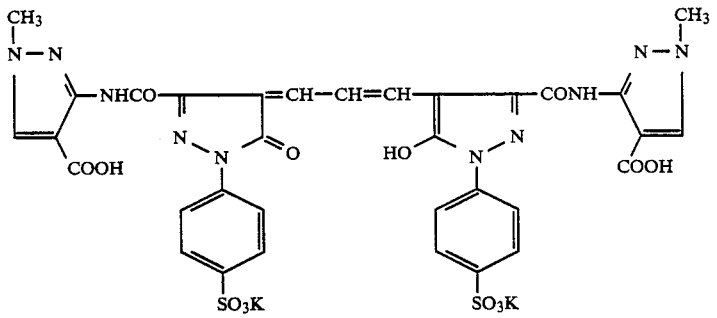

-continued
47.
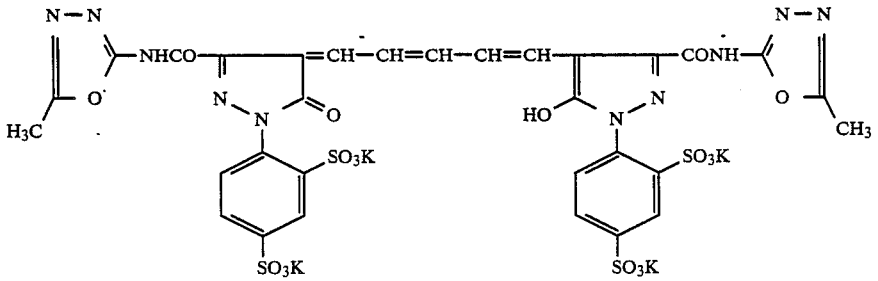
48.
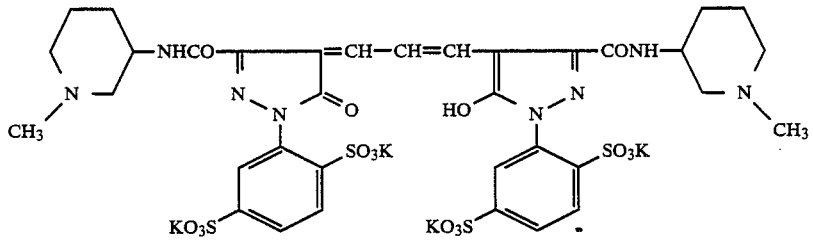
49.
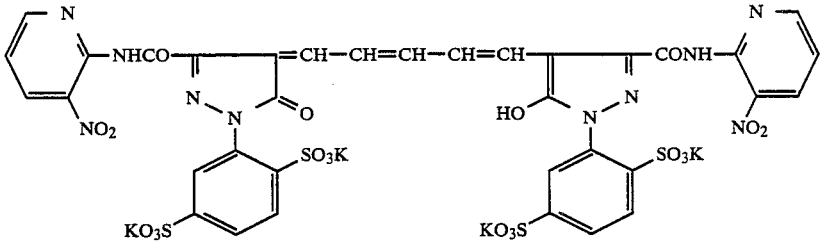
50.
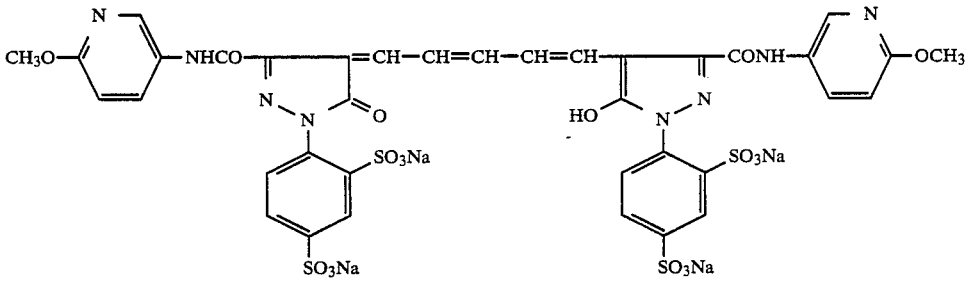
51.
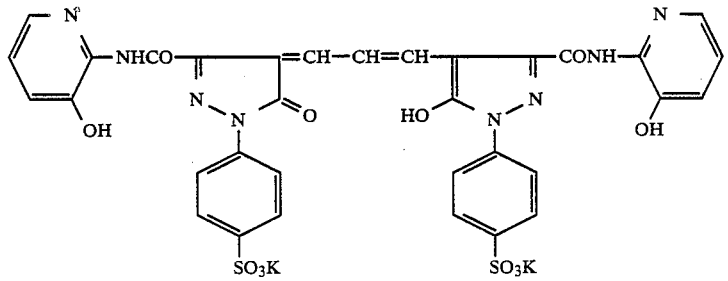
52.
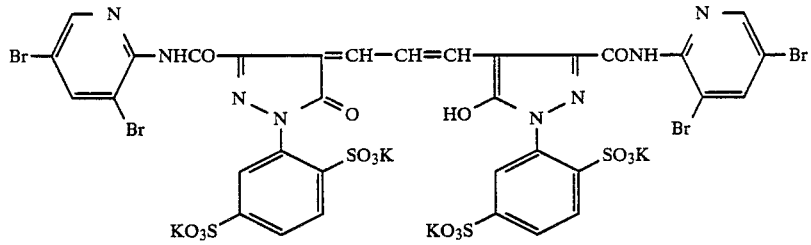

-continued
53.
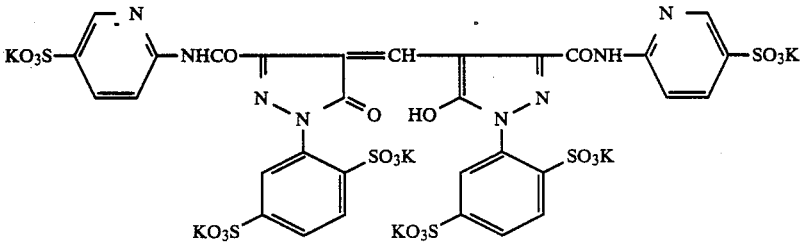
54.
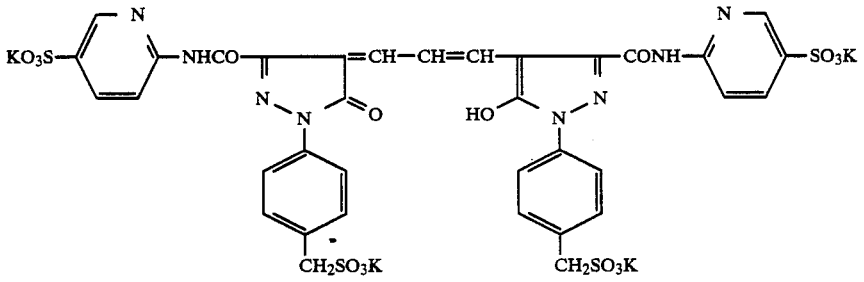
55.
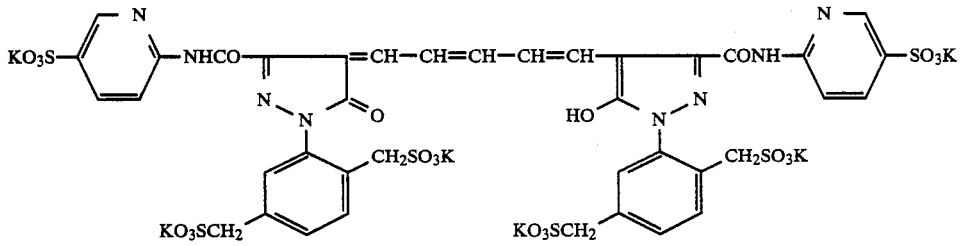
56.
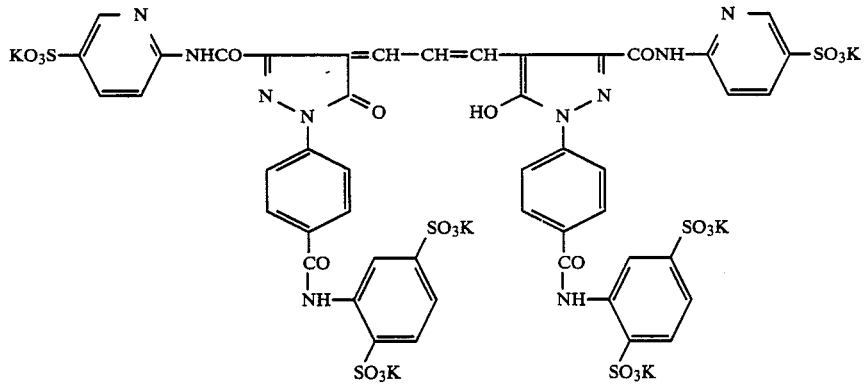
57.
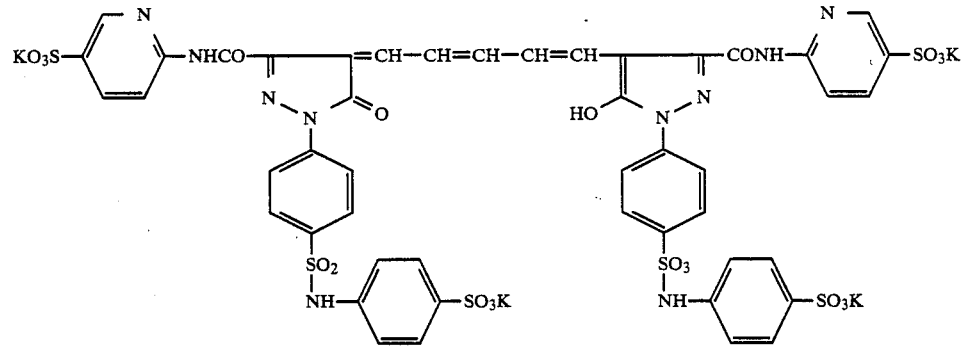

-continued
58.
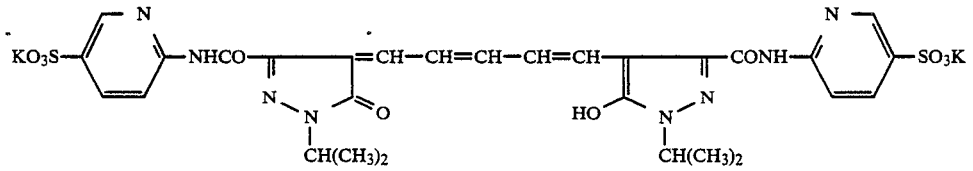
59.
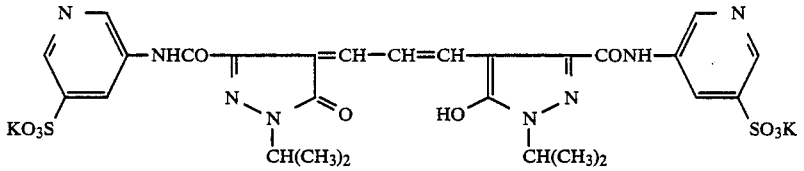
60.
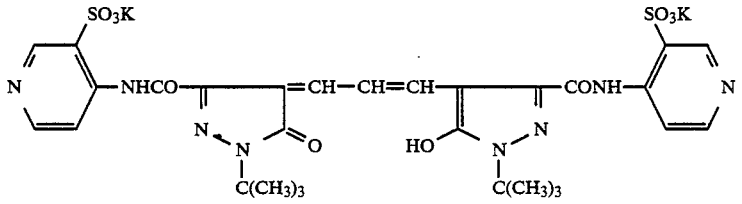
61.
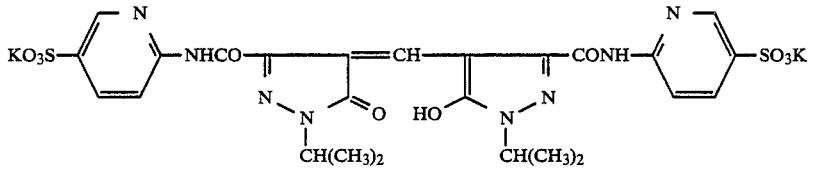
62.
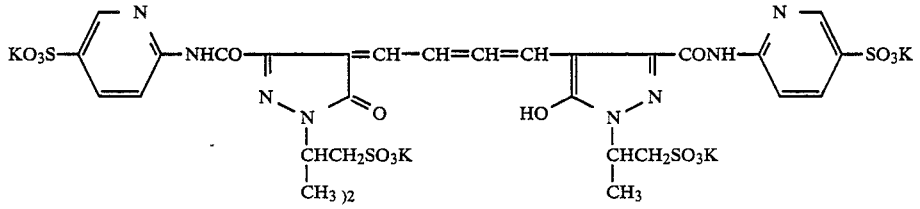
63.
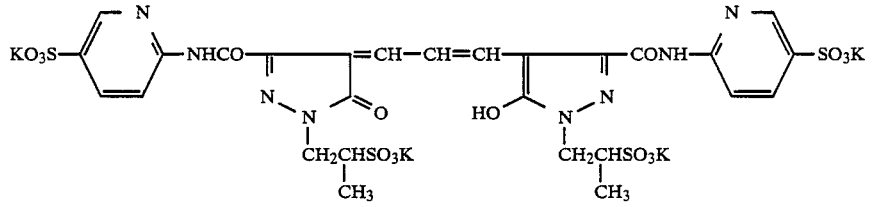
64.
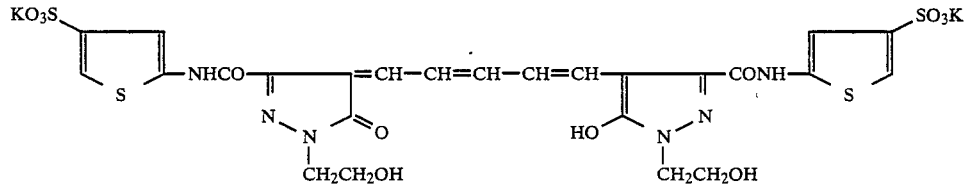
65.
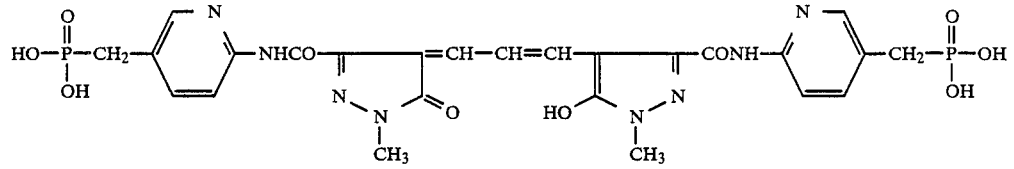

-continued
66.
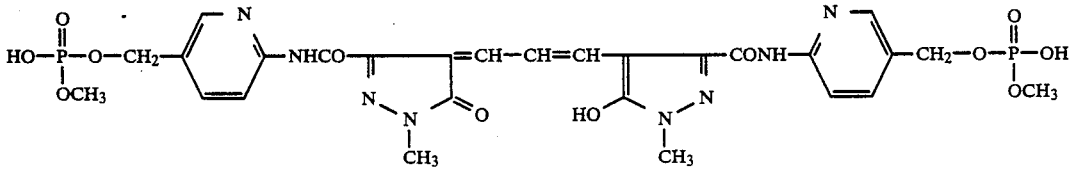
67.
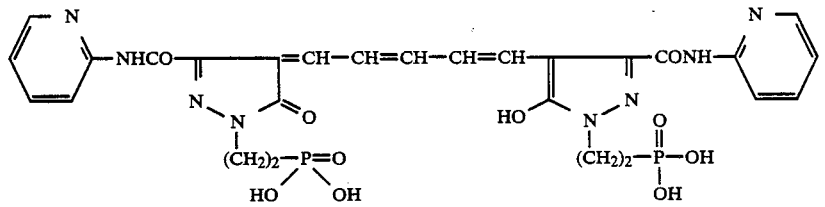
68.
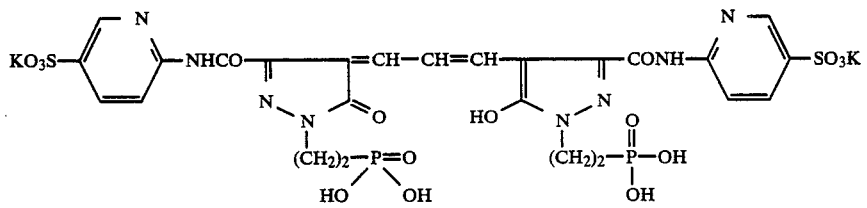
69.
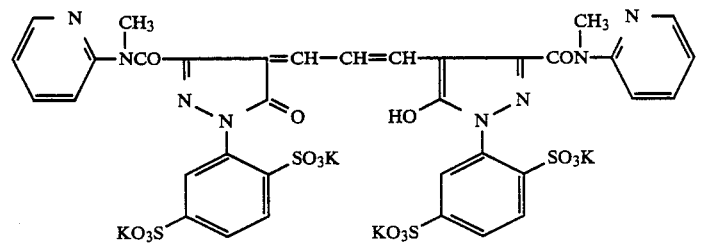
70.
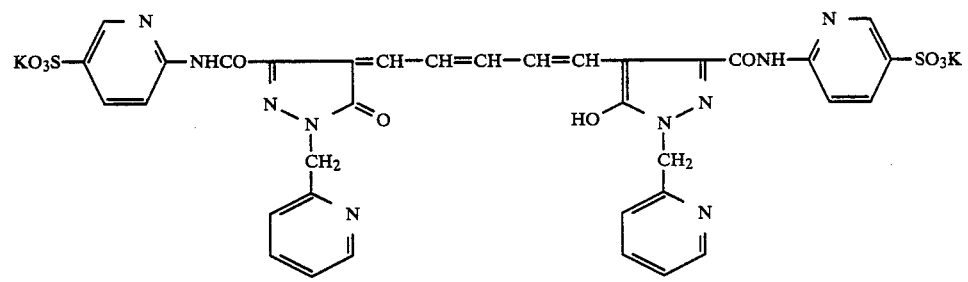
71.
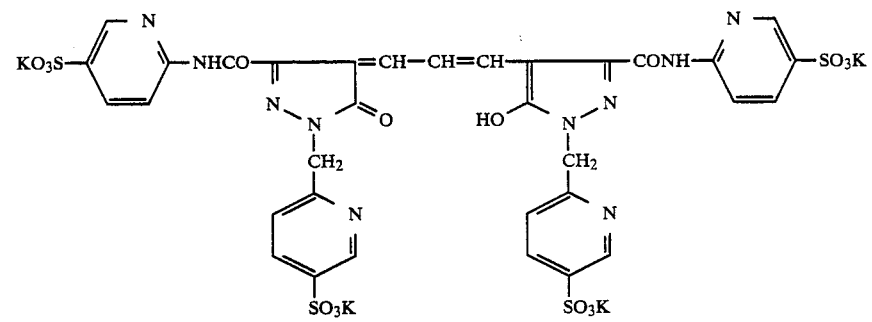

-continued
72.
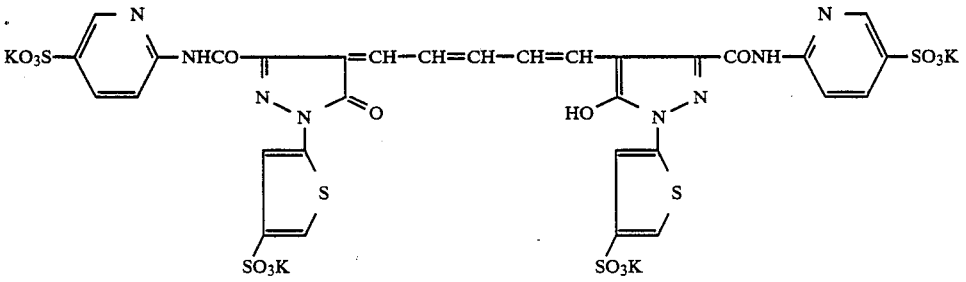
73.
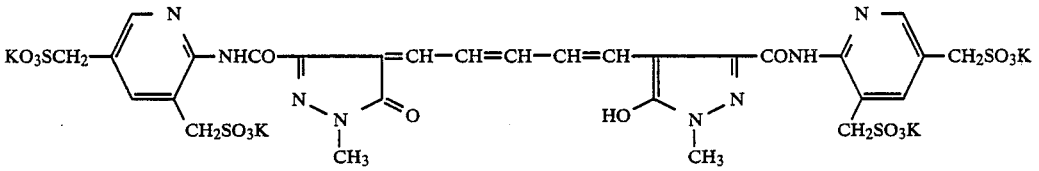
74.
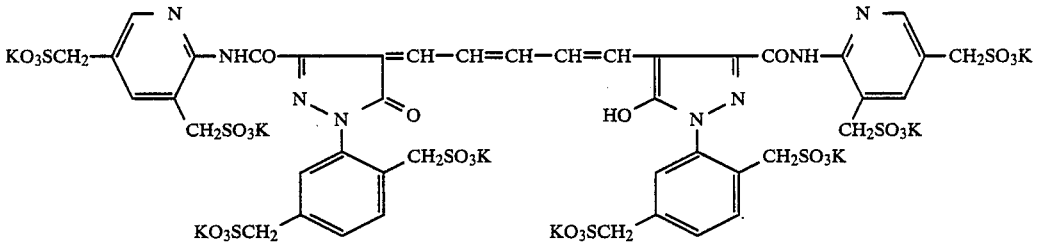
75.
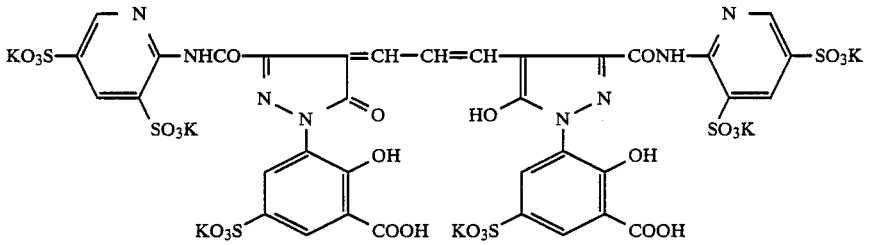
76.
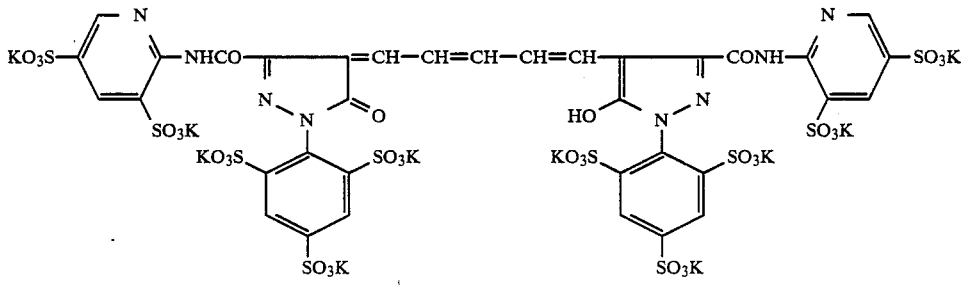
77.
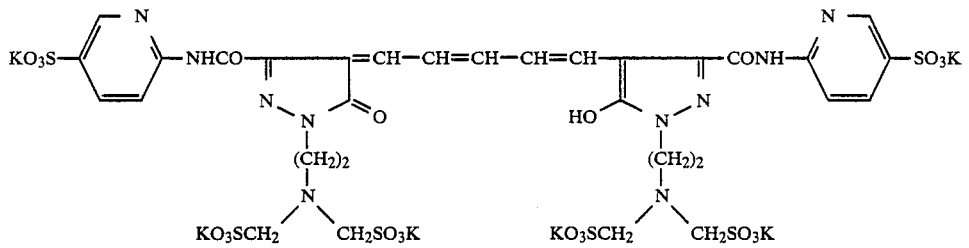

-continued

78.

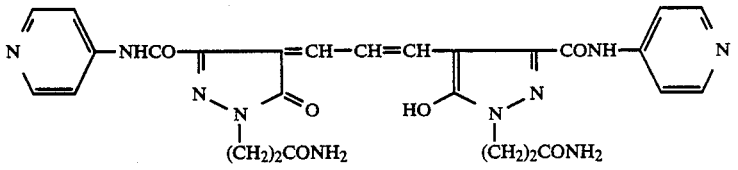

79.

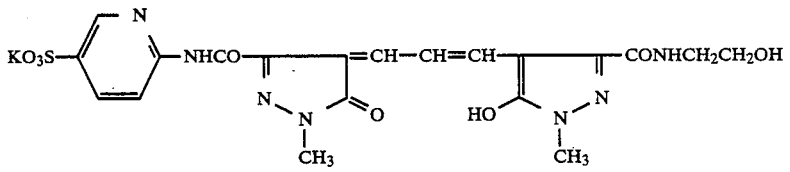

80.

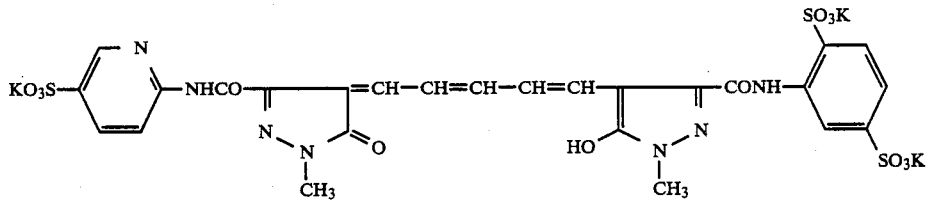

81.

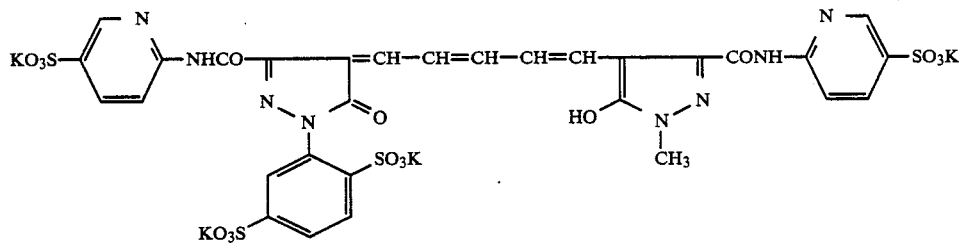

82.

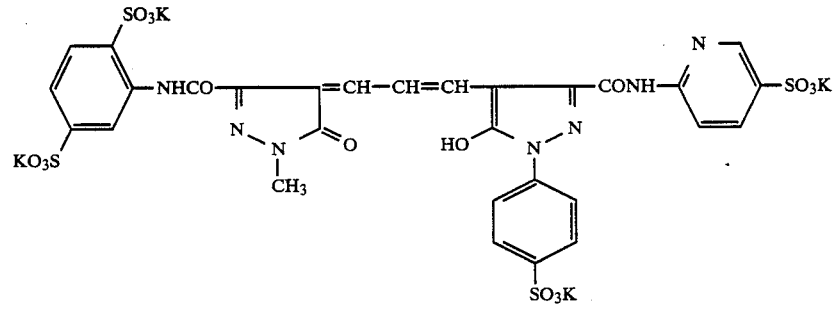

83.

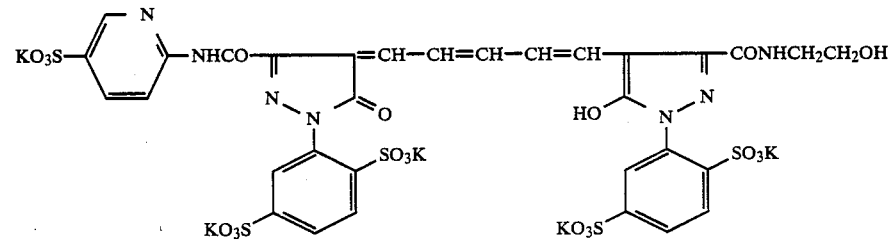

The oxonol dyes applicable to the invention may readily be sunthesized by the skilled in the art in the same manner as described in Japanese Patent O.P.I. Publication No. 58-143342(1983).

In the light-sensitive materials of the invention, the oxonol dyes represented by the foregoing formula may be added into silver halide photographic light-sensitive emulsions so as to serve as an antiirradiation dye, or they may also be added into non-light-sensitive hydrophilic colloidal layers so as to serve as a filter dye or an antihalation dye. It is also allowed to use them in combination or to use them together with the other dyes so as to meet the purposes of the use. The dyes relating to the invention may readily be added into the silver halide photographic light-sensitive emulsions or the other hydrophilic colloidal layers, in an ordinary method. The dyes are added into a photographic material usually in such a manner that the dye or the organic or inorganic alkali salt thereof is dissolved in water to make a suitably concentrated aqueous dye solution and the resulting solution is added into a coating solution and, then, the coating is carried out in a well known method, so that the dye is added into the photographic material. The dye content of a light-sensitive material depends on the purpose of the use. However, the dye is usually coated in an amount within the range of 1 to 800 mg per sq. meter of the light-sensitive material.

The materials of the supports of the photographic materials of the invention include, for example, a cellulose acetate film, a cellulose nitrate film, a polyester film such as those of polyethyleneterephthalate, a polyolefin film such as those of polyethylene, a polystyrene film, a polyamide film, a polycarbonate film, a baryta paper, a polyolefin-coated paper, a polypropylene synthetic paper, a glass plate, and a metal plate. These supports may suitably be selected out to meet the purposes of using a photographic material.

The hydrophilic colloids applicable to the photographic materials of the invention include, for example, gelatin, gelatin derivatives such as phthalated gelatin and benzene-sulfonyl gelatin, water-soluble natural macromolecular materials such as agar, casein, and alkynecarboxylic acid, synthetic resins such as polyvinyl alcohol and polyvinyl pyrolidone, and cellulose derivatives such as carboxymethyl cellulose. These hydrophilic colloids may be used independently or in combination.

The silver halide emulsions applicable to the photographic materials of the invention contain any silver halide which is usually used in a silver halide photographic emulsion, such as silver chloride, silver bromide, silver iodide, silver chlorobromide, silver iodobromide, and a silver chloroiodobromide.

The silver halide emulsions applicable to the photographic materials of the invention may be prepared in various methods having been usually carried out. The preparation methods include, for example, the conversion method described in Japanese Patent Examined Publication No. 46-7772(1971), or the method described in U.S. Pat. No. 2,592,250; and the so-called Lippmann emulsion preparation method, wherein the emulsion is comprised of a fine-grained silver halide having an average grain-size of not larger than 0.1 $\mu$. The above-mentioned silver halide emulsions may be sensitized with a chemical sensitizer including, for example: a sulfur-sensitizer such as thiosulfate, allylthiocarbamide, thiourea, allylisothiocyanate or cystine: an active or inactive selenium sensitizer; a noble-metal sensitizer such as a gold compound, e.g., potassium chloroaurate, auric trichloride, potassium auricthiocyanate or 2-aurothiabenzothiazole methylchloride, a palladium compound, e.g., ammonium chloropalladate or sodium chloropalladite, a platinium compound, e.g., potassium chloroplatinate, a ruthenium compound rhodium compound and an iridium compound; and the combination of the above-given sensitizers.

Besides the chemical sensitization, these emulsions may also be reduction-sensitized with a reducing agent, and they may further be stabilized with traizoles, imidazoles, azaindenes, benzthiazolium compounds, zinc compounds, cadmium compounds, mercaptans, or the mixtures thereof. Still further, the emulsions may contain a sensitizing compound such as thioethers, quaternary ammonium salts or polyalkylene oxides.

The photographic emulsions applicable to the photographic materials of the invention may be spectrally sensitized with a sensitizing dye, if required. Such sensitizing dyes applicable thereto include various dyes, for example, cyanine dyes, merocyanine dyes, complex cyanine dyes, oxonol dyes, hemioxonol dyes, styryl dyes, merostyryl dyes and streptocyanines. These sensitizing dyes may also be used independently or in combination.

In the photographic materials of the invention, the photographic emulsion layers and other hydrophilic colloidal layers thereof may contain glycerol, dihydroxyalkanes such as 1,5-pentanediol, esters such as ethylenebisglycol, bis-ethoxydiethyleneglycol succinate, and a water-dispersible fine-grained macromolecular compound prepared by an emulsification-polymerization, as wetting agents plasticizers, and physical surface property improving agents. Besides the above, they may also contain photographic additives including, for example, hardeners such as aldehyde compounds, N-methylol compounds, e.g., N,N'-dimethylol urea, active halogen compounds, e.g., mucohalogeno-acid, divinylsulfones and 2,4-dichloro-6-hydroxy-5-triazine, dioxane derivatives, divinyl ketones, isocyanates and carbodiimides: surfactants such as saponin, polyalkylene glycol, polyalkylene glycol ether, alkylsulfonates, alkylbenzenesulfonate and alkylnaphthalenesulfonate; and, in addition, fluorescent brightening agents, antistatic agents, antistaining agents, UV absorbents, and stabilizers.

In the photographic materials of the invention, the photographic emulsion layers thereof may contain color couplers. Such color couplers may be of the 4- or 2-equivalent type, and they may also be a colored coupler for masking use or a coupler capable of releasing a development inhibitor. The yellow-forming couplers include, for example, an open-chained ketomethylene type compound such as those of the acylacetamide type; the magenta-forming couplers include, for example, a pyrazolone type compound: and the cyan-forming couplers include, for example, a phenol type or naphthol type compound, each has been advantageously used in general.

EXAMPLES

The invention will now be detailed with reference to the examples thereof. It is however, to be understood that the invention shall not be limited thereto.

EXAMPLE 1

Gelatin in an amount of 3.5 g was dissolved into 35 ml of distilled water. Thereto, 5 ml of an aqueous solution containing $2.0\times10^{-4}$ mols of an inventive dye or a comparative dye was added and, further, 1.25 ml of an aqueous 10% saponin solution and 0.75 ml of an aqueous 1% formalin solution was then added. After then, water was added thereto to make 50 ml in total. The resulting aqueous dye solution was coated over an acetyl cellulose support and dried, so that Samples 1 through 35were prepared. The samples were processed respectively with a simulant exhausted processing solution into which the following dye was accumulated.

Each of the samples was dipped in a sodium hydroxide solution having a pH of 10.4 containing the same dye compound as that of the sample having a mol-concentration of $10/C_A$ at 30° C. for 30 seconds with stirring. $C_A$ represents a mol absorption coefficient of the dye, and so forth. The sample was washed for 15 seconds with water containing the same dye having a mol-concentration of $1/C_A$ in a tank, and dried.

The visible ray spectra of each sample obtained before and after dipping were measured and the elution ratio was obtained from the absorbance in the maximum absorption wavelength, and the result thereof is shown in Table-1.

$$\text{Elution ratio} = \frac{E_1 - E_2}{E_1} \times 100\ (\%)$$

wherein $E_1$ represents an absorbance obtained before a sample was dipped in an aqueous sodium hydroxide solution, and $E_2$ represents an absorbance obtained after dipping it.

On the other hand, each sample was dipped in the developer having the following composition at 30° C. for 30 seconds with stirring. The sample was washed with water containing the dye, that is the same as that of the sample, having a mol-concentration of $1/C_A$ in a tank for 15 seconds, and dried.

The visible ray spectra of each sample obtained before and after dipping it were measured to obtain the decoloration ratio from the absorbance in the maximum absorption wavelength. The result thereof is shown in Table-1.

$$\text{Decoloration ratio} = \frac{E_3 - E_4}{E_3} \times 100\ (\%)$$

wherein $E_3$ represents an absorbance obtained before a sample was dipped in a developer, and $E_4$ represents an absorbance obtained after dipping it.

| <Composition of Developer> | |
|---|---|
| Metol | 3.0 g |
| Sodium sulfite, anhydrous | 45.0 g |
| Sodium carbonate, monohydrate | 80.0 g |
| Potassium bromide | 2.0 g |
| Dye (Molecular weight) × ($10/C_A$) g | |
| Add water to make | 1 liter |

<Comparative dye A>

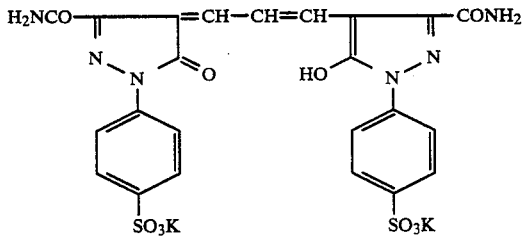

<Comparative dye B>

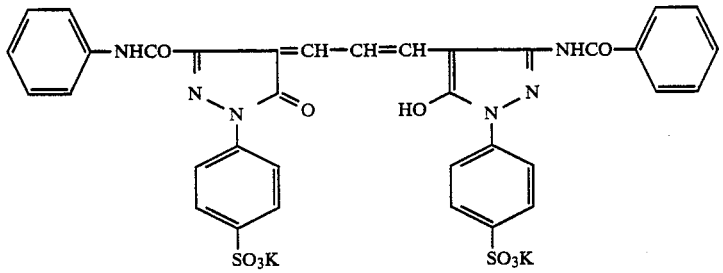

<Comparative dye C>

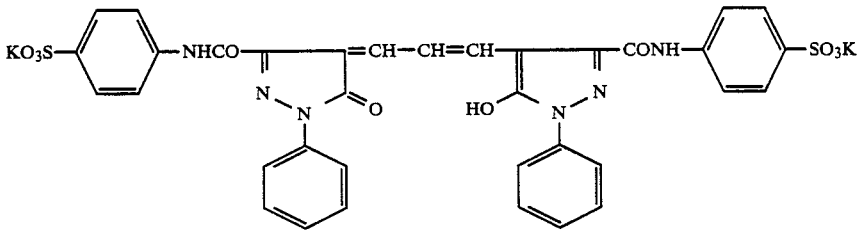

<Comparative dye D>

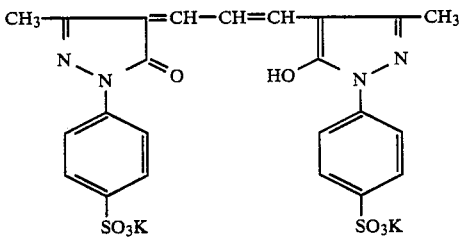

TABLE 1

| Sample No. | Dye | Ekution ratio (%) | Decoloration ratio (%) | |
|---|---|---|---|---|
| | Exemplified compound | | | |
| 1 | 1 | 95 | 97 | Invention |
| 2 | 2 | 94 | 96 | |
| 3 | 3 | 93 | 96 | |
| 4 | 4 | 94 | 96 | |
| 5 | 5 | 96 | 98 | |
| 6 | 6 | 97 | 100 | |
| 7 | 7 | 93 | 98 | |
| 8 | 9 | 93 | 96 | |
| 9 | 10 | 96 | 100 | |
| 10 | 11 | 95 | 97 | |
| 11 | 12 | 94 | 97 | |
| 12 | 13 | 96 | 98 | |
| 13 | 14 | 96 | 98 | |
| 14 | 16 | 96 | 100 | |
| 15 | 17 | 94 | 98 | |
| 16 | 18 | 95 | 99 | |
| 17 | 20 | 96 | 99 | |
| 18 | 24 | 95 | 97 | |
| 19 | 25 | 96 | 98 | |
| 20 | 28 | 93 | 97 | |
| 21 | 29 | 96 | 98 | |
| 22 | 30 | 92 | 95 | |
| 23 | 33 | 91 | 94 | |
| 24 | 35 | 92 | 95 | |
| 25 | 41 | 92 | 95 | |
| 26 | 45 | 91 | 94 | |
| 27 | 50 | 92 | 95 | |
| 28 | 52 | 92 | 95 | |
| 29 | 58 | 90 | 93 | |
| 30 | 81 | 90 | 93 | |
| 31 | 83 | 90 | 93 | |
| | Comparative dye | | | |
| 32 | A | 86 | 90 | Comparative |
| 33 | B | 85 | 90 | |
| 34 | C | 84 | 89 | |
| 35 | D | 86 | 88 | |

As is obvious from Table-1, the samples of the invention show very high values in both elution ratio and decoloration ratio, and the exemplified dyes of the invention can readily elute from gelatin layers and show excellent decoloring property as compared with the comparative dyes.

EXAMPLE 2

A color light-sensitivw material for color-printing use was prepared in the following manner. The resulting light-sensitive material sample was exposed imagewise to light and was then processed with the following color developer and bleach-fixer. With each of the dye images thereby formed, the charateristics were measured.

Preparation of Sample.

A sample was prepared in the following manner. The surface of a paper support was laminated with polyethylene containing anatase type titanium oxide serving as a white pigment. The resulting paper support was pretreated by subbing gelatin and was then coated thereon with the following layer in order.

Layer 1 : Blue light-sensitive sliver chlorobromide emulsion layer

A layer containing a silver chlorobromide emulsion having the silver chloride content of 5 mol % and a dispersion prepared by dissolving the following yellow couplers Y-1 and 2,5-di-tert-octylhydroquinone in dioctyl phthalate.

Layer 2 : First interlayer

A layer a dispersion prepared by dissolving 2,5-di-tert-octylhydroquinone in dioctyl phthalater.

Layer 3 : Green light-sensitive silver chlorobromide emulsion layer

A layer containing a silver chlorobromide emulsion having the silver chloride content of 15 mol %. a dispersion prepared by dissolving the following magenta coupler M-1 and 2,5-di-tert-octylhydroquinone in dioctyl phthalate, and an aqueous dye solution shown in the following Table-3.

Layer 4 : Second interlayer

A layer containing a dispersion prepared by dissolving the following UV absorbent UV-1 and 2,5-di-tert-octylhydroquinone, and an aqueous dye solution shown in Table-3.

Layer 5 : Red light-sensitive silver chlorobromide emulsion layer

A layer containing a silver chlorobromide emulsion having the silver chloride content of 25 mol %, and an emulsified dispersion prepared by dissolving the following cyan coupler C-1 and 2,5 -di-tert-octylhydroquinone in dioctyl phthalater.

Layer 6 : Protective layer

A layer was containing gelatin and a hardener.

Y-1

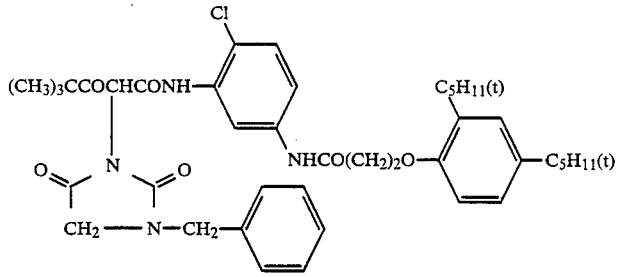

-continued

M-1

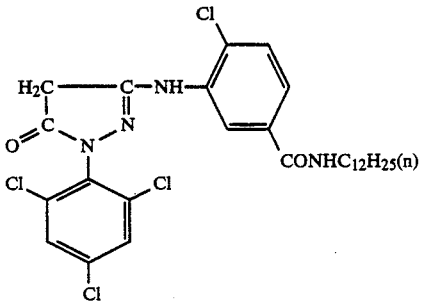

C-1

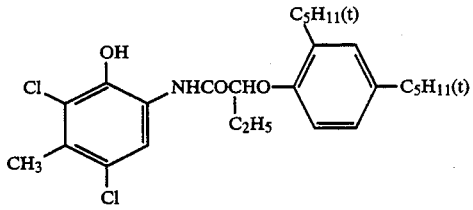

UV-1

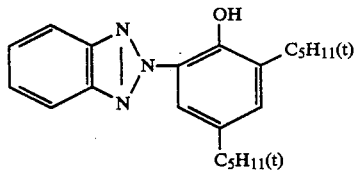

The following Table-2 shows the quantity of each component of the above-mentioned sample, in terms of milligrams per 100 $cm^2$.

TABLE 2

| Layer No. | Silver halide emulsion | UV absorbent or Coupler | 2,5-di-t-octyl hydroquinone | Gelatin |
|---|---|---|---|---|
| 1 | Blue-sensitive silver chlorobromide emulsion, 3 mg in terms of silver | Y-1 8 mg | 0.5 mg | 20 mg |
| 2 | Interlayer | — | 1.0 mg | 10 mg |
| 3 | Green-sensitive silver chlorobromide emulsion, 4 mg in terms of silver | M-1 5 mg | 0.5 mg | 15 mg |
| 4 | Interlayer | UV-1 6 mg | 1.0 mg | 10 mg |
| 5 | Red-sensitive silver chlorobromide emulsion, 3 mg in terms of silver | C-1 4 mg | 0.5 mg | 15 mg |
| 6 | Protective layer | — | — | 10 mg |

According to the layer arrangement decribed above, in the green-sensitive silver chlorobromide emulsion layer and Layer 4 that was the interlayer, the dyes of such layers were changed, so that the samples shown in Table-3 were prepared. On the other hand, in the red-sensitive silver chlorobromide emulsion layer and Layer 4 that was the interlayer, the dyes of such layers were changed so that the samples shown in Table-4 were prepared. With the resulting samples, the following items were evaluated.

<1>Fog

Unexposed samples were processed in the following processing steps. The magenta and cyan density of the resulting samples were measured with a densitometer Model D-122 manufactured by Gretag.

<2>Residual color stain

For investigating the degrees of colored stains caused by the residual colors of the dyes after the samples were processed, the same solution as the color developer used in the processing steps mentioned in the Example 1, except that N-ethyl-N-β-methanesulfonamidoethyl-3-methyl-4-aminoaniline sulfate was not used in the developer, and the same tests as mentioned in Example 1 were tried. The results thereof are shown in Tables-3 and 4. The residual color stain is mentioned simply as 'stain' in the tables.

Comparative dye E

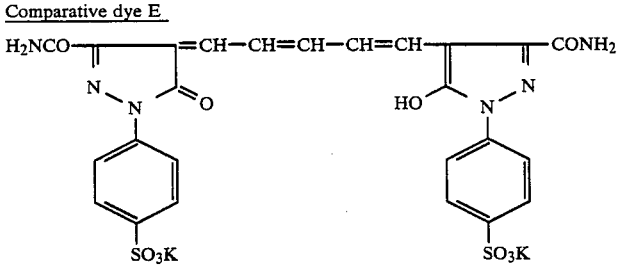

Comparative dye F

-continued

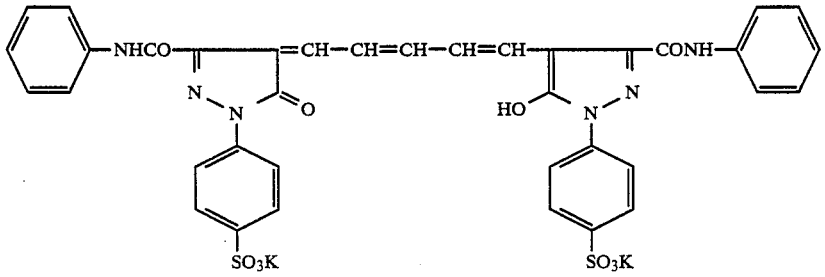

Comparative dye G

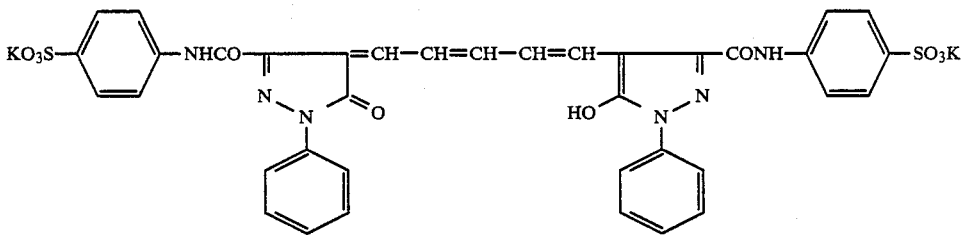

Processing steps—carried out at 38° C.—

| | |
|---|---|
| Color developing | 2 min. 30 sec. |
| Bleach-fixing | 1 min. |
| Washing | 1 min. |
| Drying 60 to 80° C., | 2 min. |

The composition of each processing solution was as follows.

| | |
|---|---|
| <Color developer> | |
| Pure water | 800 ml |
| Benzyl alcohol | 15 ml |
| Triethanolamine | 10 g |
| Hydroxylamine sulfate | 2.0 g |
| Potassium bromide | 1.5 g |
| Sodium chloride | 1.0 g |
| Potassium sulfite | 2.0 g |
| N-ethyl-N-β-methanesulfonamido-ethyl-3-methyl-4-aminoaniline sulfate | 4.5 g |
| 1-hydroxyethylidene-1,1- | 1.5 ml |

-continued

| | |
|---|---|
| diphosphonate, in an aqueous 60% solution | |
| Potassium carbonate | 32 g |
| Whitex BB, a fluorescent brightening agent manufactured by Sumitomo Chemical Co., in an aqueous 50% solution | 2 ml |
| Add pure water to make | 1 liter |
| Adjust pH with a 20% potassium hydroxide or 10% sulfuric acid solution to | pH 10.1 |
| <Bleach-fixer> | |
| Pure water | 600 ml |
| Ferric ammonium ethylenediamine-tetraacetate | 65 g |
| Disodium ethylenediamine-tetraacetate | 5 g |
| Ammonium thiosulfate | 85 g |
| Sodium hydrogensulfite | 10 g |
| Sodium metabisulfite | 2 g |
| Add pure water to make | 1 liter |
| Adjust pH with dilute sulfuric acid to | pH = 7.0 |

TABLE 3

| Sample No. | Dye in green-sensitive AgClBr emulsion layer | Dye in inter-layer <Layer-4> | Reflection density in unexposed area (1) Fog | (2) Stain | |
|---|---|---|---|---|---|
| 36 | — | — | 0.002 | 0 | Comp. Sample |
| 37 | Exemplified compound 3 0.08 | — | 0.004 | 0.002 | Sample in the Inv. |
| 38 | Exemplified compound 3 0.16 | — | 0.006 | 0.005 | Sample in the Inv. |
| 39 | — | Exemplified compound 7 0.08 | 0.003 | 0.002 | Sample in the Inv. |
| 40 | Exemplified compound 7 0.08 | Exemplified compound 7 0.16 | 0.007 | 0.005 | Sample in the Inv. |
| 41 | Exemplified compound 7 0.08 | — | 0.003 | 0.002 | Sample in the Inv. |
| 42 | — | Exemplified compound 12 0.08 | 0.004 | 0.003 | Sample in the Inv. |
| 43 | Exemplified compound 12 0.08 | — | 0.004 | 0.002 | Sample in the |

TABLE 3-continued

| Sample No. | Dye in green-sensitive AgClBr emulsion layer | Dye in inter-layer <Layer-4> | Reflection density in unexposed area (1) Fog | (2) Stain | |
|---|---|---|---|---|---|
| 44 | — | Exemplified compound 14 0.08 | 0.004 | 0.003 | Inv. Sample in the Inv. |
| 45 | Exemplified compound 14 0.08 | — | 0.004 | 0.003 | Sample in the Inv. |
| 46 | Exemplified compound 16 0.08 | — | 0.003 | 0.002 | Sample in the Inv. |
| 47 | Exemplified compound 16 0.16 | — | 0.005 | 0.003 | Sample in the Inv. |
| 48 | — | Exemplified compound 18 0.08 | 0.006 | 0.004 | Sample in the Inv. |
| 49 | Exemplified compound 24 0.08 | — | 0.003 | 0.002 | Sample in the Inv. |
| 50 | — | Exemplified compound 24 0.08 | 0.003 | 0.002 | Sample in the Inv. |
| 51 | Exemplified compound 29 0.08 | — | 0.004 | 0.002 | Sample in the Inv. |
| 52 | Exemplified compound 33 0.04 | — | 0.005 | 0.003 | Sample in the Inv. |
| 53 | Exemplified compound 52 0.08 | — | 0.007 | 0.005 | Sample in the Inv. |
| 54 | — | Exemplified compound 79 0.08 | 0.007 | 0.005 | Sample in the Inv. |
| 55 | Comparative dye A 0.08 | — | 0.009 | 0.008 | Comp. Sample |
| 56 | Comparative dye B 0.16 | — | 0.013 | 0.011 | Comp. Sample |
| 57 | — | Comparative dye B 0.08 | 0.009 | 0.008 | Comp. Sample |
| 58 | Comparative dye C 0.08 | — | 0.012 | 0.010 | Comp. Sample |
| 59 | — | Comparative dye C 0.08 | 0.012 | 0.010 | Comp. Sample |

TABLE 4

| Sample No. | Dye in red-sensitive AgClBr emulsion layer | Dye in inter-layer <Layer-4> | Reflection density in unexposed area (1) Fog | (2) Stain | |
|---|---|---|---|---|---|
| 60 | — | — | 0.003 | 0 | Comp. Sample |
| 61 | Exemplified compound 1 0.08 | — | 0.004 | 0.002 | Sample in the Inv. |
| 62 | Exemplified compound 1 0.16 | — | 0.005 | 0.003 | Sample in the Inv. |
| 63 | — | Exemplified compound 1 0.08 | 0.004 | 0.003 | Sample in the Inv. |
| 64 | Exemplified compound 1 0.08 | Exemplified compound 1 0.16 | 0.006 | 0.004 | Sample in the Inv. |
| 65 | Exemplified compound 2 0.08 | — | 0.005 | 0.003 | Sample in the Inv. |
| 66 | — | Exemplified compound 2 0.08 | 0.005 | 0.003 | Sample in the Inv. |
| 67 | Exemplified compound 5 0.08 | — | 0.004 | 0.002 | Sample in the Inv. |
| 68 | — | Exemplified compound 5 0.08 | 0.004 | 0.002 | Sample in the Inv. |
| 69 | Exemplified | — | 0.004 | 0.002 | Sample |

TABLE 4-continued

| Sample No. | Dye in red-sensitive AgClBr emulsion layer | Dye in inter-layer <Layer-4> | Reflection density in unexposed area (1) Fog | (2) Stain | |
|---|---|---|---|---|---|
| | compound 6 0.08 | | | | in the Inv. |
| 70 | Exemplified compound 10 0.08 | — | 0.004 | 0.003 | Sample in the Inv. |
| 71 | Exemplified compound 13 0.16 | — | 0.007 | 0.005 | Sample in the Inv. |
| 72 | — | Exemplified compound 13 0.08 | 0.005 | 0.003 | Sample in the Inv. |
| 73 | Exemplified compound 16 0.08 | — | 0.005 | 0.003 | Sample in the Inv. |
| 74 | — | Exemplified compound 16 0.08 | 0.005 | 0.002 | Sample in the Inv. |
| 75 | Exemplified compound 17 0.08 | — | 0.006 | 0.004 | Sample in the Inv. |
| 76 | Exemplified compound 20 0.04 | Exemplified compound 20 0.08 | 0.004 | 0.003 | Sample in the Inv. |
| 77 | Exemplified compound 45 0.08 | — | 0.007 | 0.005 | Sample in the Inv. |
| 78 | — | Exemplified compound 81 0.08 | 0.007 | 0.005 | Sample in the Inv. |
| 79 | Comparative dye E 0.08 | — | 0.010 | 0.009 | Comp. Sample |
| 80 | Comparative dye F 0.16 | — | 0.014 | 0.011 | Comp. Sample |
| 81 | — | Comparative dye F 0.08 | 0.012 | 0.010 | Comp. Sample |
| 82 | Comparative dye G 0.08 | — | 0.013 | 0.011 | Comp. Sample |
| 83 | — | Comparative dye G 0.08 | 0.013 | 0.011 | Comp. Sample |

In Tables 3 and 4, the numerals of the dyes indicate an amount of mg coated per 100 $cm^2$.

The desired whiteness of color light-sensitive materials for printing use is required to be not more than 0.005 in terms of fogginess. It is obvious from Tables 3 and 4 that the samples of the invention satisfy the requirement. In the samples of the invention, there was scarcely found such a colored stain caused by the residual colors of dyes as often found in the samples containing the comparative dyes. In other words, it was found that the dyes of the invention exert very few bad influences on emulsions.

EXAMPLE 3

Comparative multilayered color light-sensitive material sample No. 84 was prepared in such a manner that each of the layers having the following compositions was coated over a subbed triacetyl cellulose film support, in order from the support side. The amount of each component coated are expressed in terms of $g/m^2$.

| | |
|---|---|
| Layer 1: An antihalation layer | |
| UV absorbent, U-1 | 0.3 |
| UV absorbent, U-2 | 0.4 |
| High boiling solvent, O-1 | 1.0 |
| Black colloidal silver | 0.24 |
| Gelatin | 2.0 |
| Layer 2: An interlayer | |
| 2,5-di-t-octylhydroquinone | 0.1 |
| High boiling solvent, O-1 | 0.2 |

-continued

| | |
|---|---|
| Gelatin | 1.0 |
| Layer 3: A low-speed red-sensitive silver halide emulsion layer | |
| AgBrI emulsion having an AgI content of 4.0 mol % and an average particle-size of 0.25 μ, spectrally sensitized with red-sensitizing dyes S-1 and S-2 | 0.5 |
| coupler, C-1 | 0.1 mol |
| High boiling solvent, O-2 | 0.6 |
| Gelatin | 1.3 |
| Layer 4: A high-speed red-sensitive silver halide emulsion layer | |
| AgBrI emulsion having AgI content of 2.0 mol % and an average particle-size of 0.6 μ, spectrally sensitized with red-sensitizing dyes S-1 and S-2 | 0.8 |
| coupler, C-1 | 0.2 mol |
| High boiling solvent, O-2 | 1.2 |
| Gelatin | 1.8 |
| Layer 5: An interlayer | |
| 2,5-di-t-octylhydroquinone | 0.1 |
| High boiling solvent, O-1 | 0.2 |
| Gelatin | 0.9 |
| Layer 6: A low-speed green-sensitive silver halide emulsion layer | |
| AgBrI emulsion having an AgI content of 4.0 mol % and an average particle-size of 0.25 μ, spectrally sensitized with green-sensitizing dyes S-3 and S-4 | 0.6 |
| coupler, C-2 | 0.04 mol |
| coupler, C-3 | 0.01 mol |
| High boiling solvent, O-3 | 0.5 |
| Gelatin | 1.4 |
| Layer 7: A high-speed green-sensitive silver halide | |

-continued

| emulsion layer | |
|---|---|
| AgBrI emulsion having an AgI Content of 2.0 mol % and an average particle-size of 0.6 μ, spectrally sensitized with green-sensitizing dyes S-3 and S-4 | 0.9 |
| coupler, C-2 | 0.10 mol |
| coupler, C-3 | 0.02 mol |
| High boiling solvent, O-3 | 1.0 |
| Gelatin | 1.5 |
| Layer 8: An interlayer | |
| The same as Layer 5. | |
| Layer 9: A yellow filter layer | |
| Yellow colloidal silver | 0.1 |
| Gelatin | 0.9 |
| 2,5-di-t-octylhydroquinone | 0.1 |
| High boiling solvent, O-1 | 0.2 |
| Layer 10: A low-speed blue-sensitive silver halide emulsion layer | |
| AgBrI emulsion having an AgI content of 4 mol % and an average particle-size of 0.35 μ, spectrally sensitized with blue-sensitizing dye S-5 | 0.6 |
| coupler, C-4 | 0.3 mol |
| High boiling solvent, O-3 | 0.6 |
| Gelatin | 1.3 |
| Layer 11: A high-speed blue-sensitive silver halide emulsion layer | |
| AgBrI emulsion having an AgI content of 2 mol % and an average particle-size of 0.9 μ, spectrally sensitized with blue-sensitizing dye S-5 | 0.9 |
| coupler, C-4 | 0.5 mol |
| High boiling solvent, O-3 | 1.4 |
| Gelatin | 2.1 |
| Layer 12: The first protective layer | |
| UV absorbent, U-1 | 0.3 |
| UV absorbent, U-2 | 0.3 |
| High boiling solvent, O-3 | 0.6 |
| Gelatin | 1.2 |
| 2,5-di-t-octylhydroquinone | 0.1 |
| Layer 13: The second protective layer | |
| Non-light-sensitive fine-grained silver iodobromide-emulsion having an average grain-size γ of 0.08 μm and a silver iodide content of 1 mol % <In terms of silver> | 0.3 |
| Polymethyl methacrylate particle having a particle-size of 1.5 μm | |
| Gelatin | 0.7 |

Besides the above-given compositions, each layer was added with gelatin-hardener 1 and a surfactant. Further, tricresyl phosphate was also used as the solvent of the couplers.

UV absorbent U-1

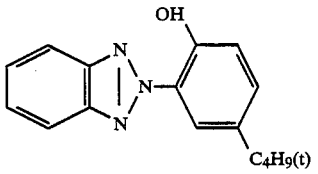

UV absorbent U-2

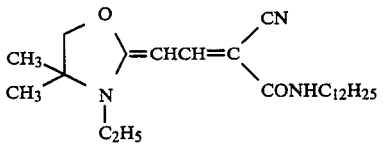

Sensitizing dye S-1

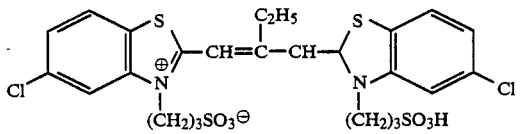

Sensitizing dye S-2

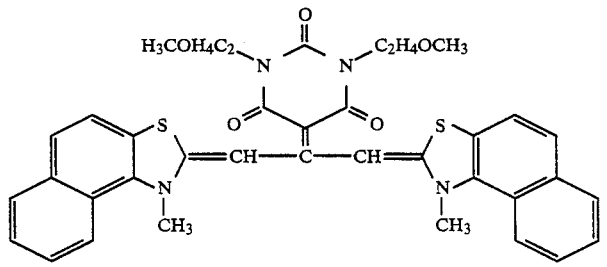

Sensitizing dye S-3

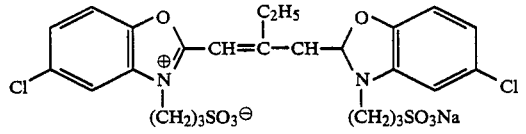

-continued
Sensitizing dye S-4
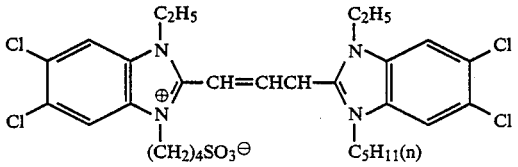
Sensitizing dye S-5
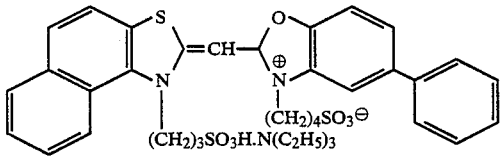
Coupler C-1
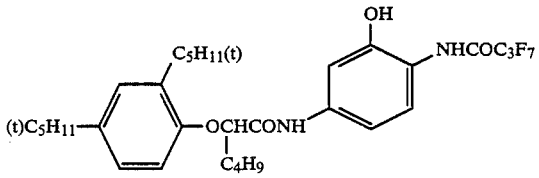
Coupler C-2
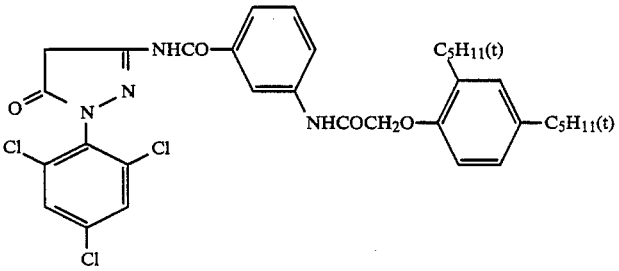
Coupler C-3
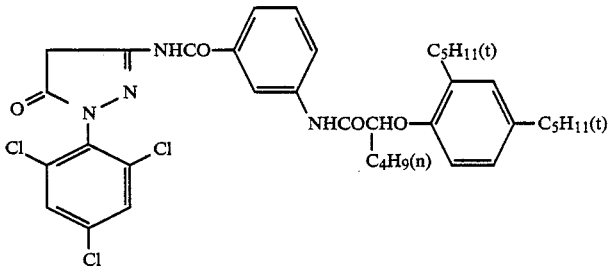
Coupler C-4
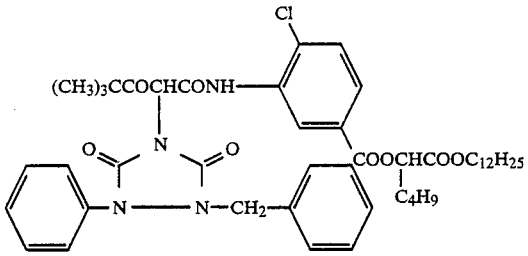
Gelatin hardener 1

-continued

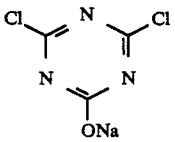

Surfactant 1

$NaO_3S-CH(CH_2COOCH_2(CF_2CF_2)_3H)COOCH_2(CF_2CF_2)_3H$

O-1

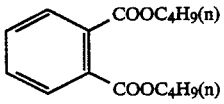

O-2

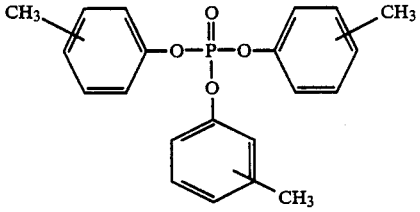

O-3

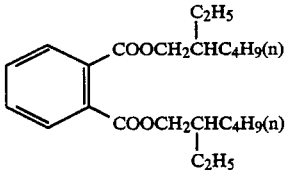

The samples shown in Table-5 were prepared by adding the compounds of the invention each in an amount of 0.01 g/m$^2$ into Layer 13, i.e., the second protective layer, of Sample No. 84, respectively. The resulting samples were evaluated as follows.

<Fog>

After the unexposed samples were preserved at 55° C. for 7 days, they were processed in the following processing steps. The resulting increases, $\Delta D_{max}$, of the maximum blue-densities of the samples caused by the preservation were shown by the values relative to that of Sample No. 84 which is regarded as a value of 100.

<Processing steps>

| Step | Time | Temperature |
|---|---|---|
| First developing | 6 min. | 38° C. |
| Washing | 2 min. | 38° C. |
| Reversing | 2 min. | 38° C. |
| Color developing | 6 min. | 38° C. |
| Moderating | 2 min. | 38° C. |
| Bleaching | 6 min. | 38° C. |
| Fixing | 4 min. | 38° C. |
| Washing | 4 min. | 38° C. |
| Stabilizing | 1 min. | at ordinary temperature |
| Drying | — | — |

The composition of the processing solutions each used in the above-mentioned processing steps were as follows.

| | |
|---|---|
| <First developer> | |
| Sodium tetrapolyphosphate | 2 g |
| Sodium sulfite | 20 g |
| Hydroquinone monosulfonate | 30 g |
| Sodium carbonate, monohydrate | 30 g |
| 1-phenyl-4-methyl-4-hydroxymethyl-3-pyrazolidone | 2 g |
| Potassium bromide | 2.5 g |
| potassium thiocyanate | 1.2 g |
| Potassium iodide, in an aqueous 0.1% solution | 2 ml |
| Add water to make | 1000 ml |
| <Reversing solution> | |
| Hexasodium nitrilotrimethylenephosphonate | 3 g |
| Sttanous chloride, dihydrate | 1 g |
| p-aminophenol | 0.1 g |
| Sodium hydroxide | 8 g |
| Glacial acetic acid | 15 ml |
| Add water to make | 1000 ml |
| <Color developer> | |
| Sodium tetrapolyphosphate | 3 g |
| Sodium sulfite | 7 g |
| Trisodium phosphate, dihydrate | 36 g |
| Potassium bromide | 1 g |
| Potassium iodide, in an aqueous 0.1% solution | 90 ml |
| Sodium hydroxide | 3 g |
| Citrazinic acid | 1.5 g |
| N-ethyl-N-β-methanesulfonamidoethyl-3-methyl-4-aminoaniline sulfate | 11 g |
| 2,2-ethylenedithiodiethanol | 1 g |
| Add water to make | 1000 ml |
| <Moderating solution> | |
| Sodium sulfite | 12 g |
| Sodium ethylenediaminetetraacetate, | 8 g |

-continued

| | |
|---|---|
| dihydrate | |
| Thioglycerol | 0.4 ml |
| Glacial acetic acid | 3 ml |
| Add water to make | 1000 ml |
| <Bleaching solution> | |
| Sodium ethylenediaminetetraacetate, dihydrate | 2 g |
| Ferric ammonium ethylenediamine tetraacetate, dihydrate | 120 g |
| Ammonium bromide | 100 g |
| Add water to make | 1000 ml |
| <Fixing solution> | |
| Ammonium thiosulfate | 80 g |
| Sodium sulfite | 5 g |
| Sodium bisulfite | 5 g |
| Add water to make | 1000 ml |
| <Stabilizer> | |
| Formalin, at 37% by weight | 5 ml |
| Konidux, manufactured by Konica Corp. | 5 ml |
| Add water to make | 1000 ml |

TABLE 5

| Sample No. | Dye | Dmax | |
|---|---|---|---|
| 84 | — | 100 | Comparative |
| 85 | Exemplified Compound 1 | 100 | Invention |
| 86 | Exemplified Compound 2 | 99 | Invention |
| 87 | Exemplified Compound 3 | 100 | Invention |
| 88 | Exemplified Compound 7 | 100 | Invention |
| 89 | Exemplified Compound 10 | 99 | Invention |
| 90 | Exemplified Compound 14 | 100 | Invention |
| 91 | Exemplified Compound 17 | 98 | Invention |
| 92 | Exemplified Compound 18 | 98 | Invention |
| 93 | Exemplified Compound 21 | 100 | Invention |
| 94 | Exemplified Compound 22 | 99 | Invention |
| 95 | Exemplified Compound 24 | 100 | Invention |
| 96 | Exemplified Compound 26 | 100 | Invention |
| 97 | Exemplified Compound 41 | 98 | Invention |
| 98 | Exemplified Compound 53 | 98 | Invention |
| 99 | Exemplified Compound 55 | 98 | Invention |
| 100 | Exemplified Compound 61 | 98 | Invention |
| 101 | Comparative dye A | 87 | Comparative |
| 102 | Comparative dye B | 85 | Comparative |
| 103 | Comparative dye C | 83 | Comparative |
| 104 | Comparative dye D | 86 | Comparative |
| 105 | Comparative dye E | 88 | Comparative |
| 106 | Comparative dye F | 87 | Comparative |

As is obvious from the results shown in Table-5, it is found that the dyes of the invention did scarcely affect emulsion performance, that is, the dyes of the invention are inactive to emulsions.

What is claimed is:

1. A silver halide photographic light-sensitive material containing a water-soluble oxonol dye represented by the following Formula I:

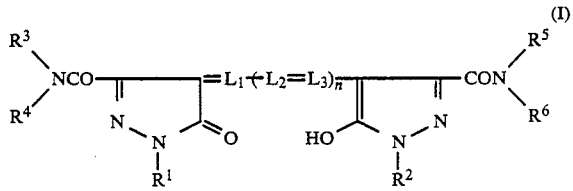

(I)

wherein $R^1$ and $R^2$ are each a hydrogen atom, an alkyl group, an aryl group or a alkenyl group; $R^3$, $R^4$, $R^5$ and $R^6$ are each a hydrogen atom, an alkyl group, an aryl group, an alkenyl group or a heterocyclic group provided that at least one of said $R^3$, $R^4$, $R^5$ and $R^6$ is a heterocyclic group and $R^3$ and $R^4$, and $R^5$ and $R^6$ are respectively allowed to bond to form a heterocyclic ring; and the groups represented by said $R^1$ through $R^6$ are allowed to be substituted or unsubstituted provided that at least one of said groups is a water-solubilizing group or a group having a water-solubilizing group; $L_1$, $L_2$ and $L_3$ are each a substituted or unsubstituted methine group; and n is an integer of zero, 1 or 2.

2. The material of claim 1, wherein said heterocyclic group represented by said $R^3$, $R^4$, $R^5$ or $R^6$ is a pyridyl group, an oxazolyl group, a thiazolyl group, an imidazolyl group, a furyl group, a pyrrolyl group, a thienyl group, a pyrazinyl group, a pyrimidinyl group, a pyridazinyl group, a purinyl group, an isoazolinyl group, a selenazolinyl group, a sulfolanyl group, a piperidinyl group, a pyrazolyl group or a tetrazolyl group, provided that these groups allowed to have a substituent.

3. The material of claim 1, wherein said $R^3$ and $R^5$ are each a hydrogen atom or an alkyl group; and $R^4$ and $r^6$ are each a heterocyclic group.

4. The material of claim 3, wherein said $R^3$ and $R^5$ are each a hydrogen atom; and $R^4$ and $R^6$ are each a heterocyclic group.

5. The material of claim 4, wherein said heterocyclic groups represented by said $R^4$ and $R^6$ are the same with each other and nitrogen atoms of the amido groups at the third position of the pyrazolone rings of Formula 1 are each directly bonded with carbon atom of each of said heterocyclic groups.

6. The material of claim 1, wherein said water-solubilizing group is a sulfo group, a sulfinyl group, a carboxy group, a phosphono group, a phosphoryl group, a hydroxy group, or a sulfric ester group.

* * * * *

UNITED STATES PATENT AND TRADEMARK OFFICE

CERTIFICATE OF CORRECTION

PATENT NO. : 4,960,686

DATED : October 02, 1990

INVENTOR(S) : Yasuhiko Kawashima et al.

It is certified that error appears in the above-identified patent and that said Letters Patent is hereby corrected as shown below:

Title Page:

In the Abstract, Line 6, after "or" change "a" to --an--;

In the Abstract, Line 14, after "groups" insert --is--;

Claim 1, Column 52, Line 14, after "or" change "a" to --an--;

Claim 3, Column 52, Line 37, change "$r^6$" to --$R^6$--;

Claim 6, Column 52, Line 49, change "carboxy" to --carboxyl--;

Claim 6, Column 52, Lines 50-51, change "hydroxy" to --hydroxyl--;

UNITED STATES PATENT AND TRADEMARK OFFICE

CERTIFICATE OF CORRECTION

PATENT NO. : 4,960,686

DATED : October 02, 1990

INVENTOR(S) : Yasuhiko Kawashima et al

It is certified that error appears in the above-identified patent and that said Letters Patent is hereby corrected as shown below:

Claim 6, Column 52, Line 51, change "sulfric" to --sulfuric acid--.

Signed and Sealed this

Twenty-seventh Day of October, 1992

*Attest:*

DOUGLAS B. COMER

*Attesting Officer*

*Acting Commissioner of Patents and Trademarks*